US011033784B2

(12) United States Patent
Hope et al.

(10) Patent No.: US 11,033,784 B2
(45) Date of Patent: Jun. 15, 2021

(54) EMBEDDED HIGH DENSITY CASTING

(71) Applicant: Karsten Manufacturing Corporation, Phoenix, AZ (US)

(72) Inventors: Alex J. Hope, Phoenix, AZ (US); Eric J. Morales, Laveen, AZ (US); Martin R. Jertson, Cave Creek, AZ (US); Trent Li, Cupertino, CA (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/163,459

(22) Filed: Oct. 17, 2018

(65) Prior Publication Data

US 2019/0105543 A1 Apr. 11, 2019

Related U.S. Application Data

(63) Continuation of application No. 15/347,654, filed on Nov. 9, 2016, now Pat. No. 10,137,335.

(60) Provisional application No. 62/252,930, filed on Nov. 9, 2015, provisional application No. 62/265,741, filed on Dec. 10, 2015, provisional application No. 62/315,445, filed on Mar. 30, 2016, provisional application No. 62/372,870, filed on Aug. 10, 2016, provisional application No. 62/406,266, filed on Oct. 10, 2016, provisional application No. 62/414,526, filed on Oct. 28, 2016.

(51) Int. Cl.

| | |
|---|---|
| ***A63B 53/04*** | (2015.01) |
| ***B22C 9/22*** | (2006.01) |
| ***B22C 7/02*** | (2006.01) |
| ***B22D 19/04*** | (2006.01) |
| ***B22D 25/02*** | (2006.01) |

(52) U.S. Cl.

CPC ..... *A63B 53/0466* (2013.01); *B22C 7/02* (2013.01); *B22C 9/22* (2013.01); *B22D 19/04* (2013.01); *B22D 25/02* (2013.01); *A63B 53/0408* (2020.08); *A63B 53/0433* (2020.08); *A63B 2053/0491* (2013.01); *A63B 2209/00* (2013.01)

(58) Field of Classification Search

CPC ..... A63B 53/0466; A63B 2053/0408; A63B 2053/0433; A63B 2053/0491; A63B 2209/00; B22C 7/02; B22C 9/22; B22D 19/04; B22D 25/02

USPC ..... 473/349

See application file for complete search history.

(56) References Cited

U.S. PATENT DOCUMENTS

| | | | | |
|---|---|---|---|---|
| 4,558,505 | A | 12/1985 | Moore | |
| 5,241,738 | A | 9/1993 | Colvin | |
| 5,398,746 | A * | 3/1995 | Igarashi | A63B 53/0466 164/108 |
| 5,577,550 | A | 11/1996 | Schmidt | |
| 5,595,234 | A | 1/1997 | Beck | |
| 5,595,548 | A | 1/1997 | Beck | |
| 5,651,409 | A | 7/1997 | Sheehan | |

(Continued)

OTHER PUBLICATIONS

ISR & WO dated Jan. 19, 2017 from corresponding PCT Application No. PCT/US2016/061178, filed Nov. 9, 2016.

*Primary Examiner* — John E Simms, Jr.
*Assistant Examiner* — Rayshun K Peng

(57) ABSTRACT

Described herein is a golf club head having a body and a high density metal piece integrally embedded within the golf club head body, wherein a gap is disposed between the exterior surface of the high density metal piece and the exterior of the golf club head body and a method of manufacturing thereof.

11 Claims, 19 Drawing Sheets

(56) References Cited

U.S. PATENT DOCUMENTS

| | | | | |
|---|---|---|---|---|
| 5,651,932 | A | 7/1997 | Butler | |
| 5,753,170 | A | 5/1998 | Muang | |
| 5,766,091 | A | 6/1998 | Humphrey | |
| 5,868,635 | A | 2/1999 | Aizawa et al. | |
| 6,056,649 | A * | 5/2000 | Imai | A63B 53/04 473/328 |
| 6,945,307 | B2 | 9/2005 | Tsai | |
| 8,302,658 | B2 | 11/2012 | Gilbert et al. | |
| 2004/0092332 | A1 | 5/2004 | Willett et al. | |
| 2007/0287554 | A1 * | 12/2007 | Gilbert | A63B 53/04 473/349 |
| 2012/0083359 | A1 * | 4/2012 | Stites | A63B 53/0466 473/334 |
| 2012/0289361 | A1 * | 11/2012 | Beach | A63B 53/06 473/338 |
| 2015/0190686 | A1 | 7/2015 | Li | |
| 2016/0101330 | A1 * | 4/2016 | Harrington | A63B 53/047 473/338 |

* cited by examiner

EMBEDDED HIGH DENSITY CASTING

CROSS REFERENCE TO RELATED APPLICATION

This claims the benefit of U.S. patent application Ser. No. 15/347,654 filed Nov. 9, 2016, which claims the benefit of U.S. Provisional Patent Application No. 62/252,930, filed on Nov. 9, 2015, U.S. Provisional Patent Application No. 62/265,741, filed on Dec. 10, 2015, U.S. Provisional Patent Application No. 62/315,445, filed on Mar. 30, 2016, U.S. Provisional Patent Application No. 62/372,870, filed on Aug. 10, 2016, U.S. Provisional Patent Application No. 62/406,266, filed on Oct. 10, 2016, and U.S. Provisional Patent Application No. 62/414,526, filed on Oct. 28, 2016, the contents of all of which are incorporated fully by reference herein.

FIELD OF THE INVENTION

The present disclosure relates to a golf club head, and more specifically to a high density metal piece (HDMP) that is coupled to a body of a golf club head.

BACKGROUND

A golfer benefits from having a club that will provide good ball flight characteristics even when the ball is mishit. Movement of mass around or within a club head is one major aspect of club head design used to improve ball flight. Mass can be placed to move the center of gravity (CG) of the club head down and rearward. Maximizing placement of a high density mass within the club head is, however, limited by current techniques.

A high density metal piece is typically inserted into the body of a club head by welding, brazing, or swaging or, alternatively, a metal piece is affixed to the body using adhesives or configured as a threaded insert into the body of the club head. During, these processes multiple forces are exerted on the high density metal piece making it difficult to accurately place the metal piece consistently. The art has need of a process that both requires fewer processing steps and provides greater design freedom.

DETAILED DESCRIPTION

Figure 1:
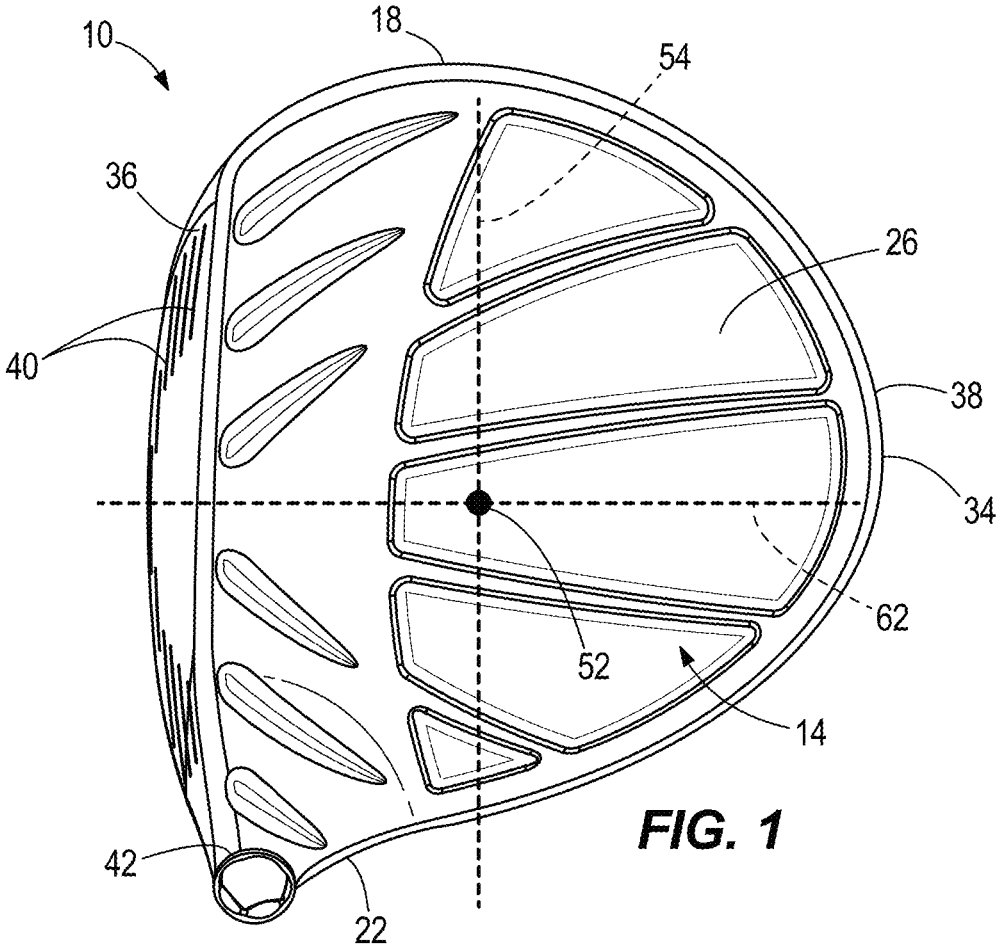
FIGS. 1 and 2 are top and front views, respectively, of a golf club head having an x-axis, a y-axis, and a z-axis according to one construction.

Described herein is an embedded casting process to manufacture a golf club head including a high density metal piece. The embedded casting process allows for a metal piece to be inserted into the body using fewer processing steps and provides greater design freedom. The high density metal piece is configured to allow for accurate and consistent placement of the metal piece within the golf club head when installed using the embedded casting process defined below. The high density metal piece can include protrusions and/or gaps, both of which are defined in more detail below, to prevent any undesired translations or rotations due to forces applied during the casting process.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

As described herein, "embedded casting" can refer to the casting or molding of a material having any viscosity over a part that is already formed. Embedded casting can be performed using any material, such as metals or plastics.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

In accordance with one construction, an investment casting part for a golf club head includes a high density metal piece at least partially embedded within a wax shell, the high density metal piece having a body with at least two protrusions that extend from the body and away from the wax shell, the two protrusions extending along axes that are offset relative to one another.

In accordance with another construction, an investment casting part for a golf club head includes a high density metal piece including a body having a surface, a first protrusion extending from the surface, and a second protrusion extending from the surface offset from the first protrusion. The investment casting part also includes a wax encasement. The wax encasement surrounds the body. The first protrusion and the second protrusion each extend away from the wax encasement.

In accordance with another construction, an investment casting part for a golf club head, the head being that of a metal wood, includes a high density metal piece including a body having a surface and a cylindrical or non-cylindrical protrusion extending from the surface, the protrusion including a notch formed therein. The investment casting part includes a wax encasement with an outer surface, wherein the wax encasement at least partially surrounds the body, further wherein the notch is free from contact with the wax encasement.

In accordance with another construction, a golf club head includes a body having a sole, a striking face, a crown, a heel end, and a toe end. The golf club head also includes a high density metal piece coupled to the body, wherein a gap is disposed between an exterior surface of the high density metal piece and an exterior surface of the body, wherein a filler material is disposed within the gap.

In accordance with another construction, a method of manufacturing a golf club head include forming a high density metal piece, the high density metal piece having two protrusions, the two protrusions extending along axes that are offset relative to one another. The method also includes placing the high density metal piece in a wax injection mold, injecting wax into the wax injection mold such that portions of the protrusions are not embedded within the wax, coating the wax with ceramic such that the portions of the protrusions are disposed within the ceramic and prevent rotation and translation of the high density metal piece, melting out the wax, pouring metal into the ceramic, and removing the ceramic.

In accordance with another construction, a method of manufacturing a golf club head include forming a high density metal piece, the high density metal piece having at least one protrusion, placing the high density metal piece in a wax injection mold, injecting wax into the wax injection mold such that a portion of the at least one protrusion is not embedded within the wax, coating the wax with ceramic such that the portion of the at least one protrusion is disposed within the ceramic and prevents rotation of the high density metal piece, melting the wax to form a hollow region between the ceramic and the high density metal piece, pouring metal into the hollow region, and removing the ceramic. After the ceramic is removed, a gap is disposed between an exterior surface of the high density metal piece and an exterior surface of the body. The method then includes inserting a filler material into the gap.

In accordance with another construction, a method of manufacturing a golf club head include forming a high density metal piece, the high density metal piece having a gap disposed between an exterior surface of the high density metal piece and an exterior of the surface body, the gap extending at least partially around the perimeter of the high density metal piece. The method also includes placing the high density metal piece in a wax injection mold, injecting wax into the wax injection mold such that the gap is not filled with wax, coating the wax with ceramic such that the gap receives the ceramic material and prevents rotation and translation of the high density metal piece, melting out the wax, pouring metal into the ceramic, and removing the ceramic.

In accordance with another construction, a partially assembled golf club head includes a body having a sole, a striking face, a crown, a heel end, and a toe end. The partially assembled golf club also includes a high density metal piece coupled to the body, wherein a gap is disposed between an exterior surface of the high density metal piece and an exterior surface of the body, wherein the high density metal piece includes two protrusions extending away from the golf club head.

In accordance with another construction, an investment casting part for a golf club head includes a high density metal piece including a body having a surface, a first protrusion extending from the surface, and a second protrusion extending from the surface offset from the first protrusion, wherein the body includes a plurality of through-holes.

In accordance with another construction, an investment casting part for a golf club head includes a high density metal piece including a body having a surface, a first protrusion extending from the surface, and a second protrusion extending from the surface offset from the first protrusion, wherein the surface includes a plurality of depressions.

Figure 2:
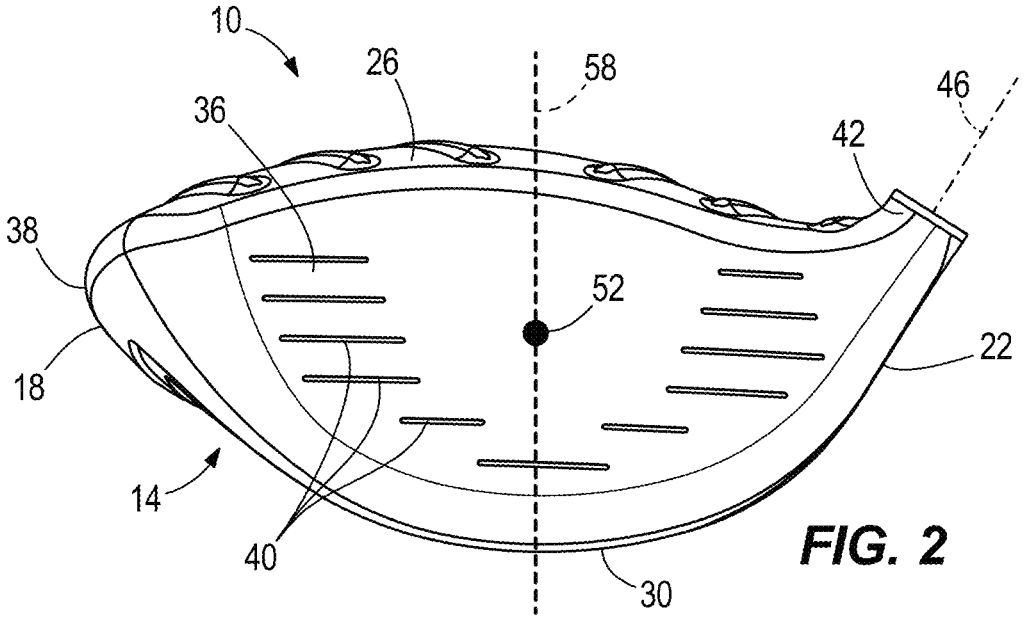
Figure 3:
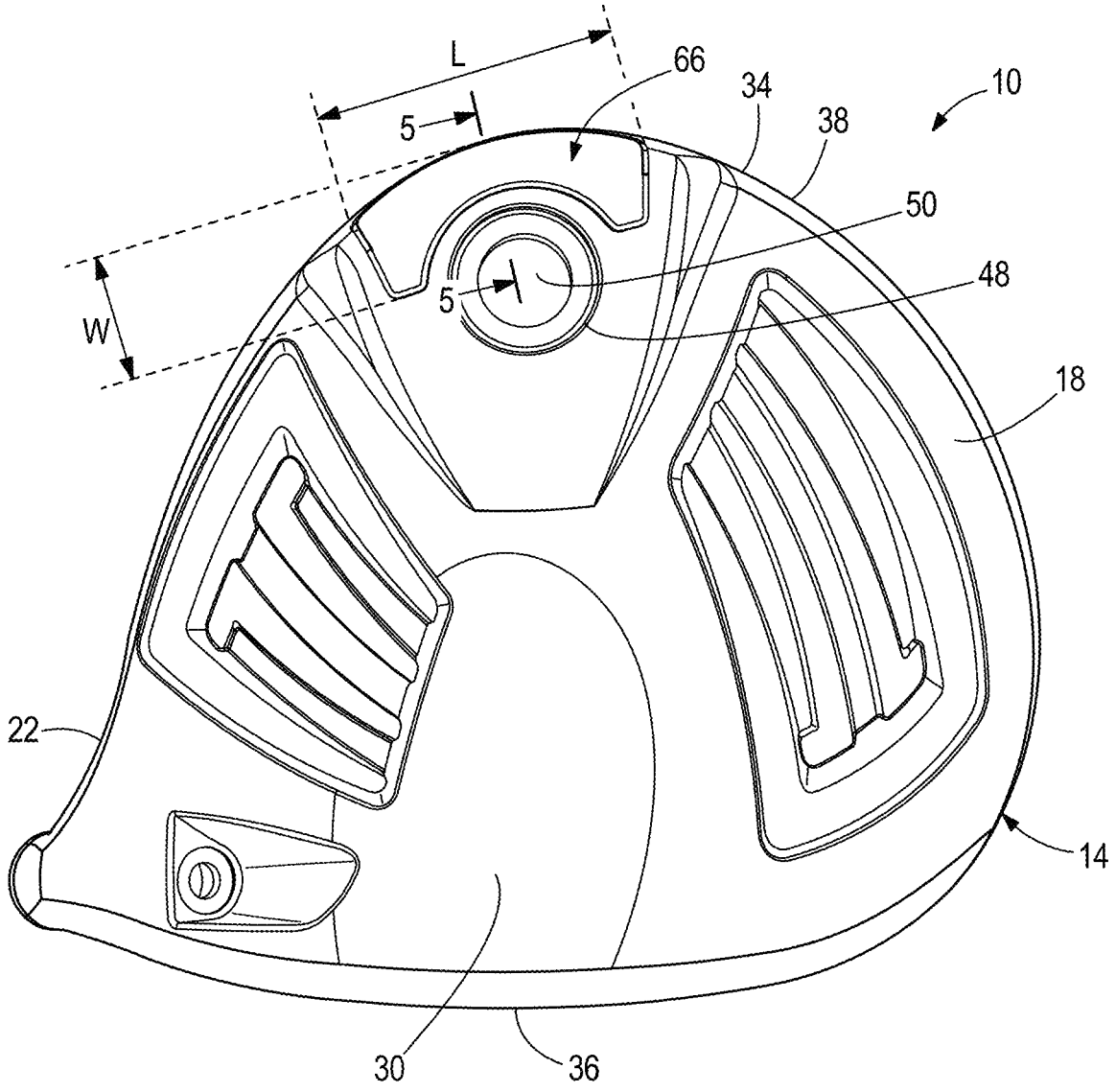
FIG. 3 is a bottom view of the golf club head of FIGS. 1 and 2, showing an HDMP coupled to a body of the golf club head.

FIGS. 1-3 illustrate a golf club head 10. The golf club head 10 includes a golf club head body 14 having a toe or toe end 18 opposite a heel or heel end 22. The golf club head body 14 also includes a crown or top 26 opposite a sole or bottom 30, and a back or rear or back end 34 opposite a club face or face or strike face or strike plate 36. The golf club head 10 also includes a perimeter 38 that joins the sole or bottom 30 to the crown or top 26. The club face or face or strike face or strike plate 36 is joined to each of the crown or top 26, the sole or bottom 30, and the perimeter 38.

With reference to FIGS. 1 and 2, a plurality of grooves or primary grooves 40 is positioned on the club face 36. The golf club head 10 also includes a hosel 42 having a hosel axis 46 that extends through a center of the hosel 42. The hosel 42 is configured to receive a golf club shaft (not shown) that carries a grip (not shown).

With reference to FIG. 3, the golf club head 10 also includes an opening 48 in the sole or bottom 30. The opening 48 is threaded, and a correspondingly threaded swing weight adjustment piece 50 is received into the opening 48 (e.g., during assembly of the golf club head 10).

With reference to FIGS. 1 and 2, the golf club head 10 also has a center of gravity or CG 52 that defines an origin of a coordinate system including an x-axis 54, a y-axis 58, and a z-axis 62. The x-axis 54 extends through the golf club head 10 center of gravity or CG 52 from the toe end 18 to the heel end 22. The y-axis 58 extends through the golf club head 10 center of gravity or CG 52 from the crown 26 to the sole 30. The z-axis 62 extends through the center of gravity or CG 52 from the club face 36 to the back 34.

With reference to FIG. 3, the golf club head 10 further includes at least one high density metal piece (HDMP) 66 coupled to the golf club head body 14. In the illustrated construction, a single HDMP 66 is coupled to the golf club head body 14 at the back end 34, and along the sole or bottom 30, in an area of transition from a rear of the sole or bottom 30 to the perimeter 38 of the golf club head 10. In other constructions, a different number and/or placement HDMPs 66 is provided.

The HDMP 66 is made of a material that is of higher density than the golf club head body 14. The HDMP 66 adds weight to the back end 34 and affects the location of the center of gravity or CG 52. In the illustrated construction, the HDMP 66 is positioned as far back as possible toward the back or rear or back end 38 along the z-axis 62 and is positioned as low as possible toward the sole or bottom 30 along the y-axis 58, to provide an optimum positioning for the center of gravity or CG 52. In the illustrated construction, the HDMP 66 is made of tungsten. In some constructions, the HDMP 66 is made of tantalum, rhenium, osmium, iridium, or platinum, or other high density metals, although other constructions include different materials.

In some constructions, the HDMP 66 may have the same or a different melt temperature than a melt temperature of the material forming the golf club head body 14. In some constructions, the HDMP 66 has a melt temperature greater than 0° C., greater than 100° C., greater than 200° C., greater than 300° C., greater than 400° C., greater than 500° C., greater than 600° C., or greater than 700° C. different than a melt temperature of the material forming the golf club head body 14.

With reference to FIGS. 3-6, in the illustrated construction the HDMP 66 has a curved, oblong shape that generally matches a contour of the golf club head body 14 along the rear of the sole 30. In some constructions, the HDMP 66 has a rectangular, trapezoidal, elliptical, circular, or other-shaped cross section.

Figure 4:
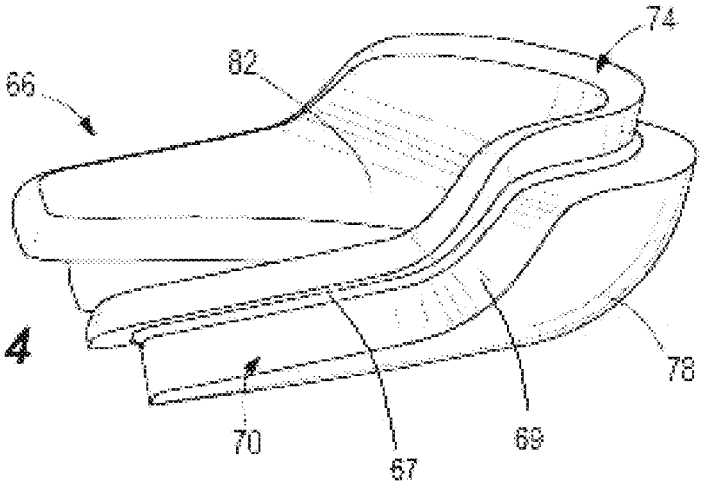
FIG. 4 is a perspective view of the HDMP of FIG. 3.
Figure 5:
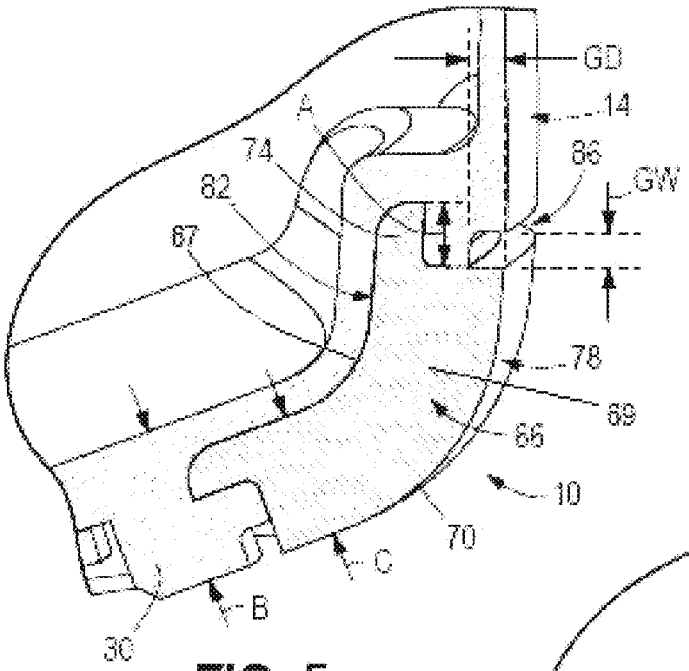
FIG. 5 is a partial, cross-sectional view of the golf club head of FIGS. 1-3, showing a gap formed around the HDMP and disposed between the HDMP and the golf club head body.

With specific reference to FIGS. 4 and 5, in the illustrated construction the HDMP 66 includes a body 69 having a base portion 70 and a top portion 67, wherein the top portion 67 comprises half of the HDMP 66 positioned towards the interior of the golf club head body 14 and the base portion 70 comprises the other half of the HDMP 66 closest to the exterior of the golf club head body 14. The top portion 67 can include a flange 74 extending from top portion 67 of the body 69. The flange 74 can extend entirely around a perimeter of the HDMP 66. In other constructions, the flange 74 can extend only around a portion of the perimeter of the HDMP 66. The base portion 70 includes a first surface 78 and the top portion 67 includes a second surface 82 disposed opposite the first surface 78.

With reference to FIG. 5, the combination of the body 69 and the flange 74 forms a generally "T"-shaped profile in cross-section. The flange 74 extends a distance "A" along a direction away from the body 69. In some constructions, the distance "A" ranges between 0.005 inch and 2.0 inches. Other values and ranges are also possible. For example, in some constructions, the distance "A" is between 0.005 inch and 1.0 inch. In some constructions, the distance "A" is between 0.005 inch and 1.5 inches. In some constructions the distance "A" is between 0.005 inch and 2.5 inches. In some constructions, the distance "A" is between 0.005 inch and 3.0 inches.

The flange 74 is disposed inward, toward a center of the golf club head 10, and the base portion 70 is disposed outward and along an outside of the golf club head 10, such that the first surface 78 of the base portion 70 is visible along the outside of the golf club head 10. The first surface 78 is an outward, exposed surface that defines an outer curvature and is flush with or generally follows or is continuous with an outer curvature of the golf club head body 14 such that the profile of the golf club head body 14 is uninterrupted. The second surface 82 is an inward, concealed surface that defines an inner curvature and faces toward the center of the golf club head 10. As illustrated in FIG. 5, the first surface 78 and the second surface 82 each define a curvature of varying radius, such that the HDMP 66 bends slightly and forms generally an "L-shape." The radius of curvature of the first surface 78 is greater than the radius of curvature of the second surface 82. Other constructions include different shapes and curvatures for the HDMP 66 than that illustrated.

With continued reference to FIG. 5, in the illustrated construction the golf club head body 14 has a thickness "B" in an area of the HDMP 66, and the HDMP 66 has a thickness "C" as measured between the first surface 78 and the second surface 82. In some constructions, the thickness "B" is 0.15 inch, and the thickness "C" is 0.10 inch. In other constructions, the thickness "B" and thickness "C" can include different values and ranges. For example, in some constructions, the thickness "B" is between 0.10 inch and 1.0 inch. In some constructions, the thickness "B" can be 0.1 inch, 0.15 inch, 0.20 inch, 0.25 inch, 0.3 inch, 0.35 inch, 0.4 inch, 0.45 inch, 0.5 inch, 0.55 inch, 0.6 inch, 0.65 inch. 0.7 inch, 0.75 inch, 0.8 inch, 0.85 inch, 0.9 inch, 0.95 inch, or 1.0 inch. In some constructions, the thickness "C" is between 0.05 inch and 1.0 inch. In some constructions, the thickness "C" can be 0.05 inch, 0.1 inch, 0.15 inch, 0.20 inch, 0.25 inch, 0.3 inch, 0.35 inch, 0.4 inch, 0.45 inch, 0.5 inch, 0.55 inch, 0.6 inch, 0.65 inch. 0.7 inch, 0.75 inch, 0.8 inch, 0.85 inch, 0.9 inch, 0.95 inch, or 1.0 inch.

With reference to FIG. 3, the HDMP 66 also has an overall length "L" and an overall width "W," as measured in a plane that is perpendicular to the y-axis 58. In the illustrated construction, the length "L" and the width "W" are each greater than the thickness "C" illustrated in FIG. 5, such that the HDMP 66 forms a relatively thin, oblong-shaped structure that fits into a natural profile of the golf club head body 14.

Figure 6:
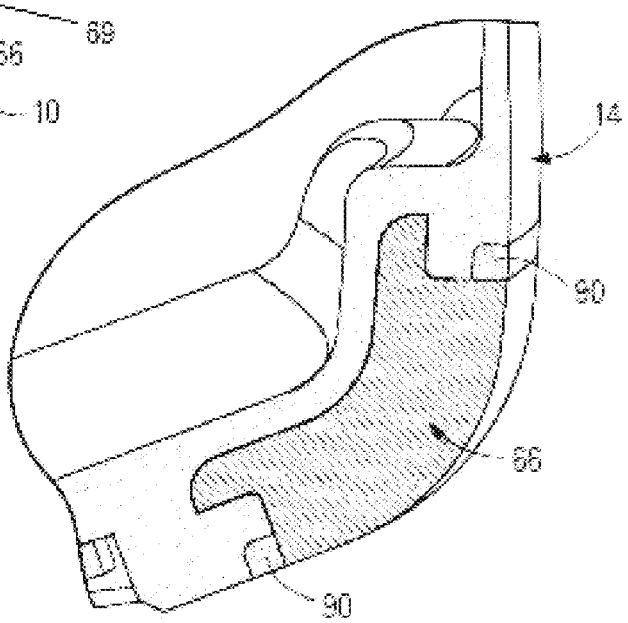
FIG. 6 illustrates filler material disposed within the gap shown in FIG. 5.
Figure 30:
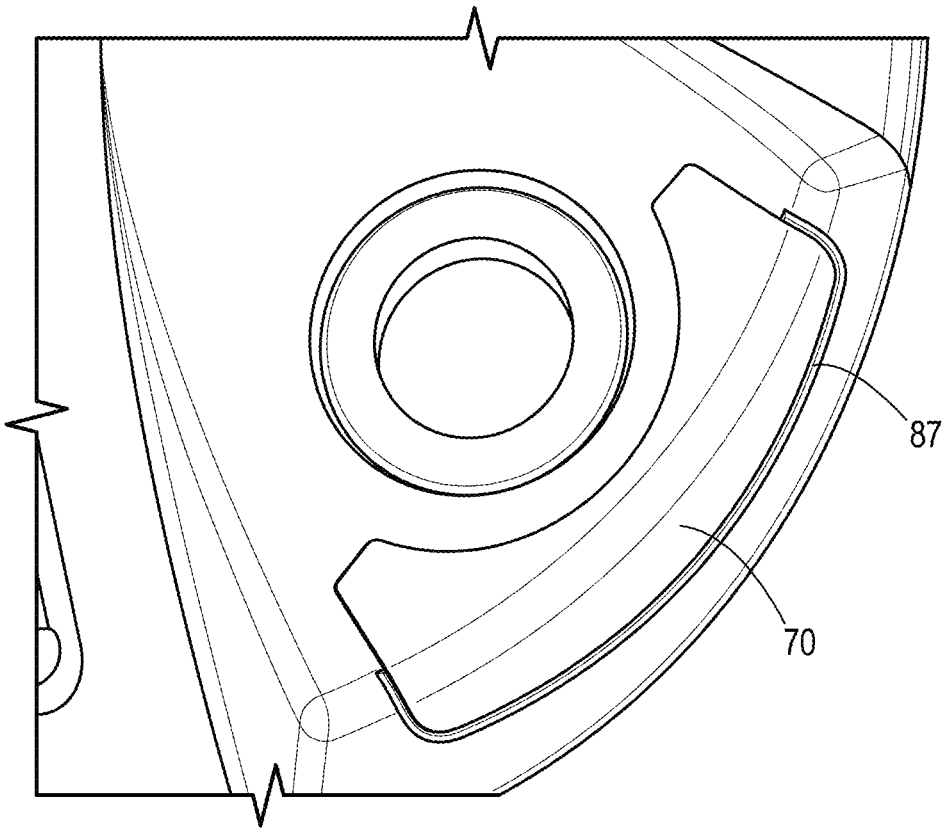
FIG. 30 is a perspective view of an embodiment of an HDMP coupled to a body of the golf club head.
Figure 31:
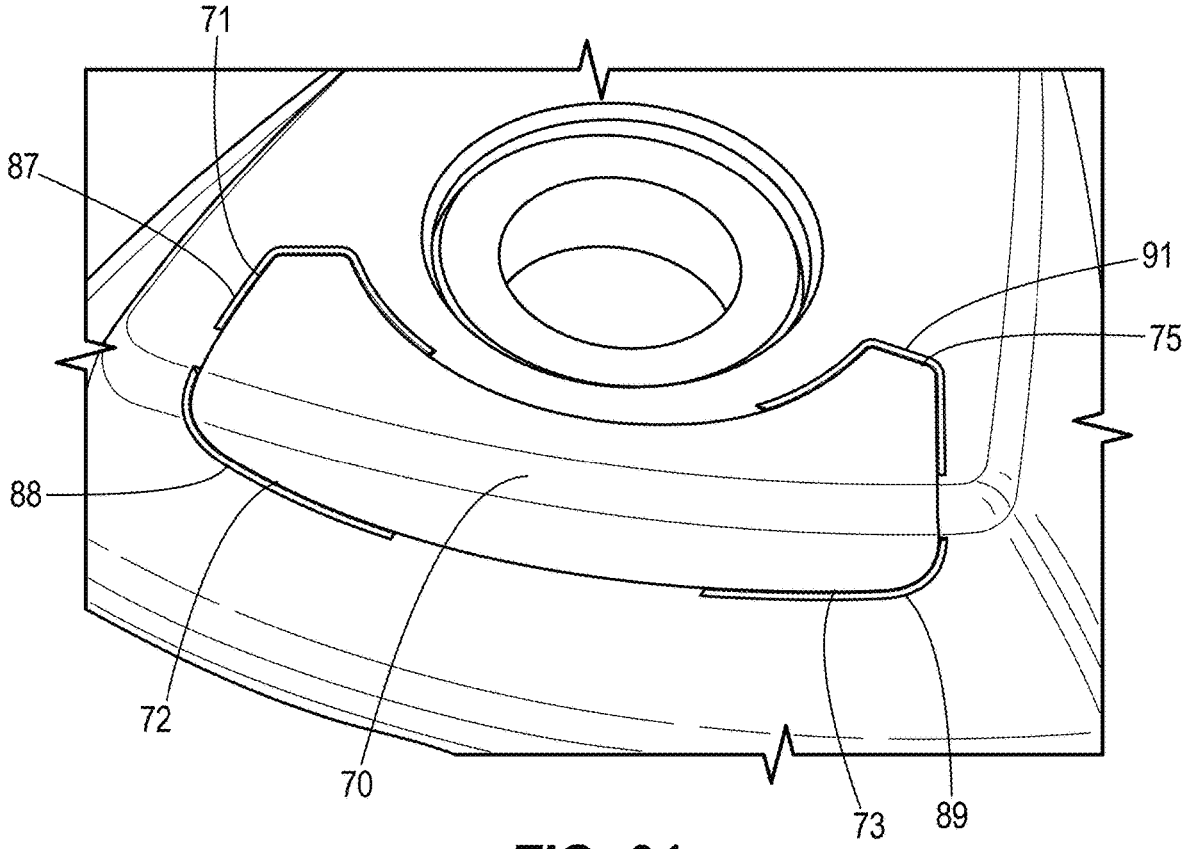
FIG. 31 is a perspective view of another embodiment of an HDMP coupled to a body of the golf club head.
Figure 32:
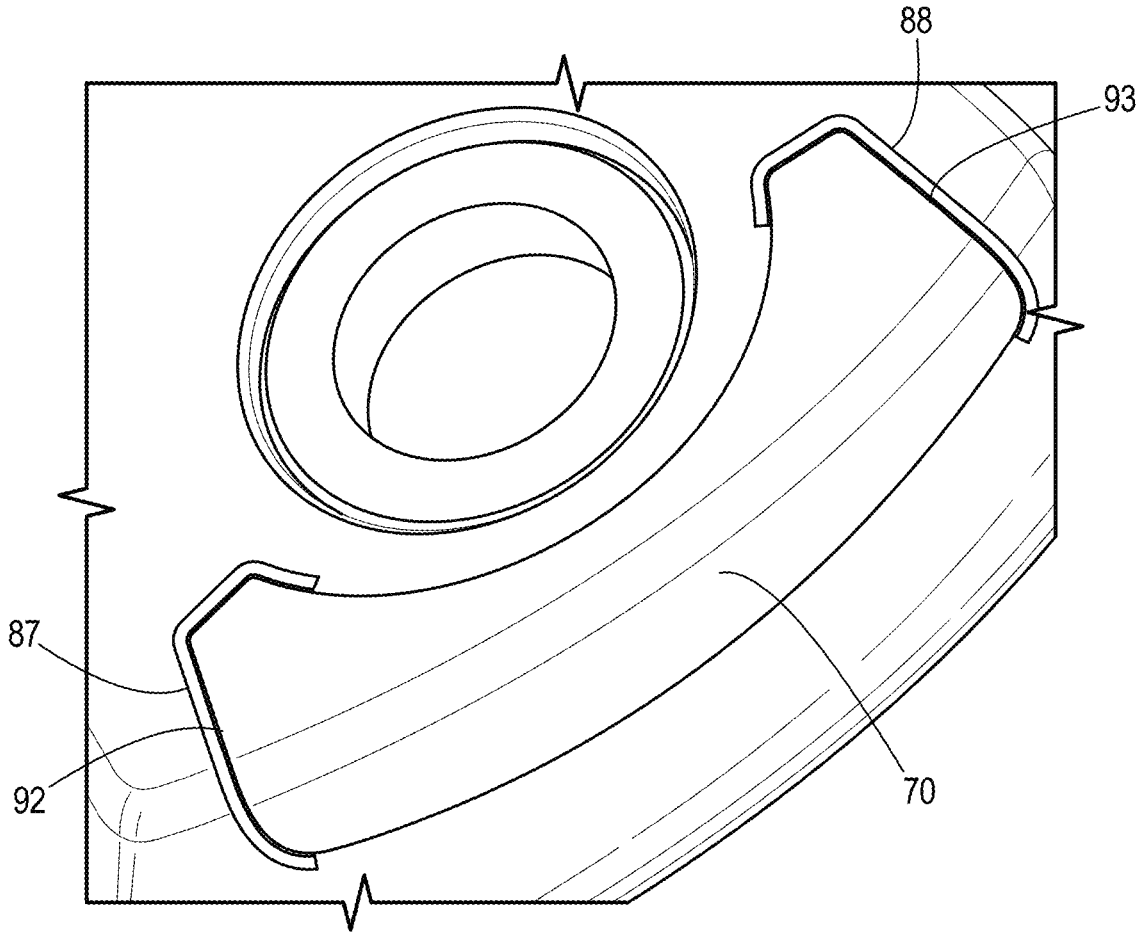
FIG. 32 is a perspective view of another embodiment of an HDMP coupled to a body of the golf club head.
Figure 33:
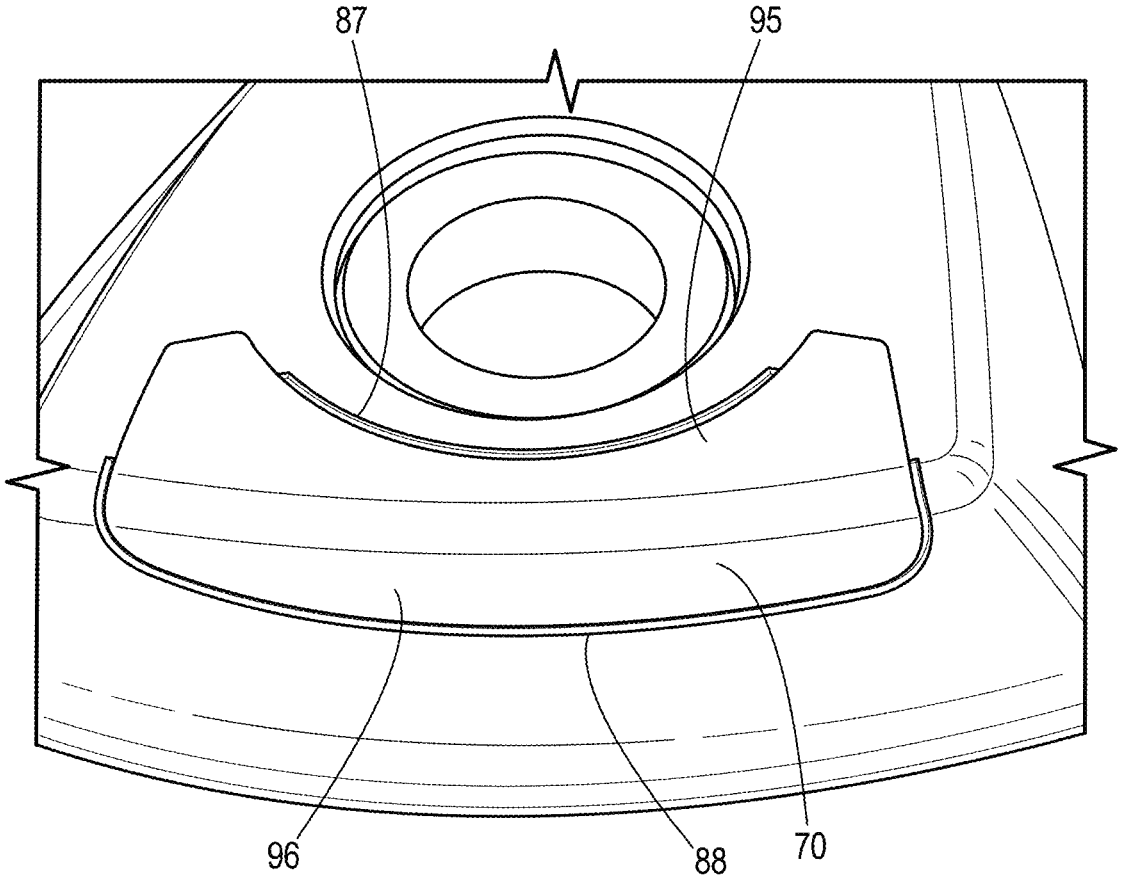
FIG. 33 is a perspective view of another embodiment of an HDMP coupled to a body of the golf club head.

With reference to FIGS. 5 and 6, the HDMP 66, in combination with the golf club head body 14, forms a gap or void, or recess, or notch, or depression, or groove 86 (FIG. 5) between the first surface 78 of the base portion 70 and the golf club head body 14 along an exterior of the golf club head 10. In many constructions, the gap 86 can extend entirely around the perimeter of the base portion 70. The gap 86 may extend towards the interior of the club head, exposing the perimeter of the base portion 70, wherein oxidation and discoloration caused during the manufacturing process are not visible on the exposed first surface 78. The base portion 70 and the first surface 78 being the portion of the HDMP 66 which will be exposed to the exterior of the golf club head 10 when the casting process 94 is completed. In some constructions, the gap 86 can extend partially around the perimeter of the base portion 70 creating a gap section. In other constructions, the gap 86 can include one or more portions extending at least partially around the perimeter of the base portion 70 creating a plurality of gap sections. For example, referring to FIG. 30, the gap can include a single first gap portion 87 extending around approximately half of the perimeter of the base portion 70. For further example, referring to FIG. 31, the gap 86 can include a first gap portion 87 positioned at a corner 71 of the base portion 70, a second gap portion 88 positioned at a second corner 72 of the base portion 70, a third gap portion 89 positioned at a third corner 73 of the base portion 70, and a fourth gap portion 91 positioned at a fourth corner 75 of the base portion 75. For further example, referring to FIG. 32, the gap 86 can include a first gap portion 87 positioned at a left side 92 of the base portion 70, and a second gap portion 88 positioned at a right side 93 of the base portion 70. For further example, referring to FIG. 32, the gap 86 can include a first gap portion 87 positioned at a front side 95 of the base portion 70, and a second gap portion 88 positioned at a back side 96 of the base portion 70. In other examples, the gap can comprise any combination of the aforementioned gap sections and positions. The gap 86 is formed, at least in part, due to the first surface 78 having a shorter length (e.g., arc length) than the second surface 82, and/or due to the presence of the flange 74. The gap 86 formed between the first surface 78 and the golf club head body 14 comprises a gap depth "GD" extending in a direction generally inwardly toward a center of the club head exposing a part of the base portion 70. In the illustrated construction, the gap 86 is between 0.01 inch and 1 inch deep "GD", although other values and ranges are also possible. For example, in some constructions, the gap 86 is between 0.01 and 1.5 inches deep. In other constructions, the gap 86 can be 0.01, 0.05, 0.1, 0.2, 0.3, 0.4, 0.5, 0.6, 0.7, 0.8, 0.9, 1.0, 1.1, 1.2, 1.3, 1.4, and 1.5 inches deep. Further, the gap 86 comprises a gap width "GW" extending in direction between the first surface 78 and the outer surface of the golf club head body 14, and perpendicular to the gap depth direction. In the illustrated construction, the gap 86 is also between 0.01 inch and 1 inch wide in a gap width direction "GW" (i.e., in a direction extending in direction between the first surface 78 and the outer surface of the golf club head body 14, and perpendicular to the gap depth direction), although other values and ranges are also possible. For example, in some constructions the gap 86 is between 0.01 inch and 1.5 inches wide. In some constructions, the gap 86 can be 0.01, 0.05, 0.1, 0.2, 0.3, 0.4, 0.5, 0.6, 0.7, 0.8, 0.9, 1.0, 1.1, 1.2, 1.3, 1.4, and 1.5 inches wide.

With reference to FIG. 6, the gap 86 is filled with a filler material 90. In the illustrated construction, the filler material 90 is a flexible material, such as paint, epoxy, rubber, silicon, or other flexible material(s), although other constructions include different materials.

Figure 7:
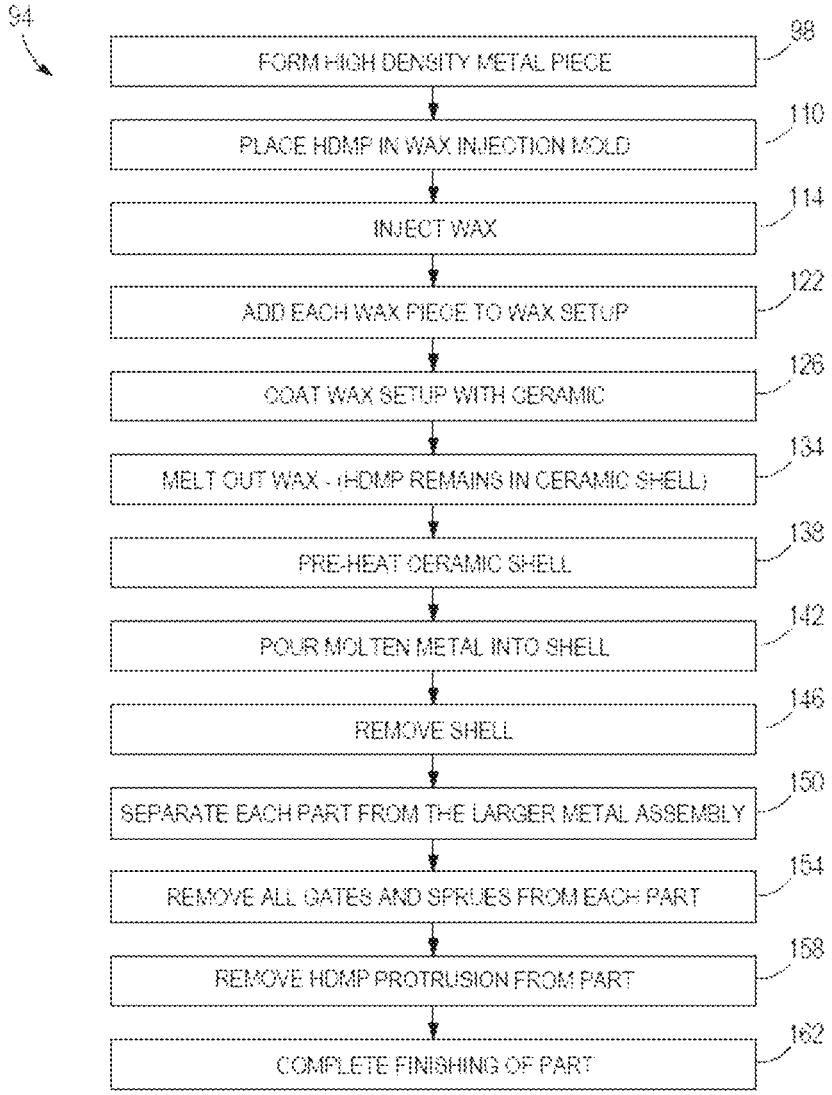
FIG. 7 is a flowchart of an embedded casting process for forming the golf club head of FIGS. 1-3 and for coupling the HDMP to the golf club head body.

FIG. 7 illustrates an embedded casting process 94 for forming the golf club head 10 and for coupling the HDMP 66 to the golf club head body 14 as illustrated in FIGS. 1-6.

With reference to FIG. 7, the embedded casting process 94 includes a first step 98 of forming the HDMP 66. The HDMP 66 is formed, for example, by machining, casting, metal injection molding, direct laser sintering, powdered metal forming processes, or other appropriate processes known to those skilled in the art.

Figure 8:
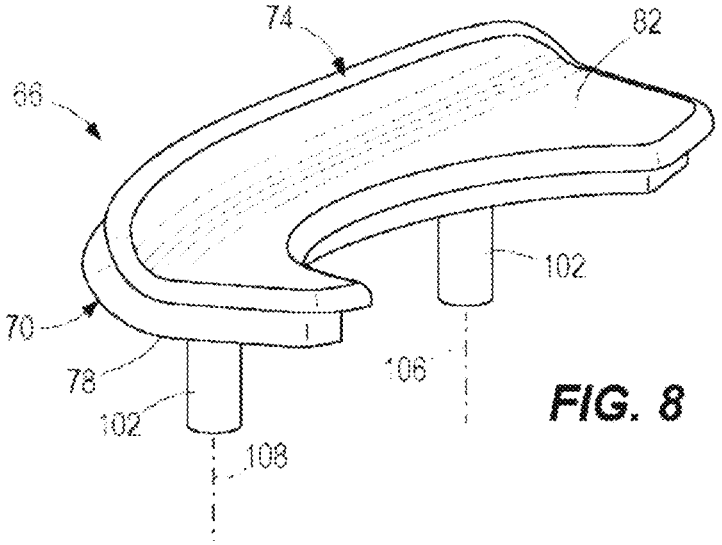
FIG. 8 is a perspective view of the HDMP during part of the process of FIG. 7, the HDMP having protrusions in the form of two cylindrical posts.

With additional reference to FIG. 8, when the HDMP 66 is first formed, the HDMP 66 initially includes at least one protrusion 102. In the illustrated construction, the HDMP 66 includes two protrusions 102 in the form of posts. The two protrusions 102 extend (e.g., perpendicularly) from the first surface 78 of the base portion 70 of the HDMP 66, and are integrally formed as part of the HDMP 66 (e.g., as monolithic extensions). The two protrusions 102 define axes 106, 108 offset from one another. In the illustrated construction, the two axes 106, 108 are parallel to one another, although in some constructions the two axes 106, 108 are skewed relative to one another, or intersect one another. Each of the two protrusions 102 extends along its respective axis 106, 108 away from the first surface 78. In the illustrated construction, each of the protrusions 102 extends between 0.2 and 10 inches along its respective axis 106, 108 away from the first surface 78, although other constructions include different values and ranges. In some constructions, the protrusions 102 each extend between 0.2 and 1 inch away from the first surface 78. In some constructions, the protrusions 102 each extend between 0.2 and 5 inches away from the first surface 78. In some constructions, one of the protrusions 102 extends a longer distance away from the first surface 78 than the other protrusion 102. In some constructions, the HDMP 66 includes only a single protrusion 102 extending a longer distance (e.g., between 5 and 10 inches).

In some constructions the HDMP 66 includes a plurality of protrusions 102 each extending a shorter distance (e.g., between 0.2 and 5 inches).

The protrusions 102 also each have a cross-sectional area. In the illustrated construction, the protrusions 102 each have circular cross-sections defining a cross-sectional area between 0.005 square inch and 0.010 square inch, although other constructions include different values and ranges. In some constructions, each of the protrusions 102 has a cross-sectional area of between 0.005 square inch and 0.015 square inch. In some constructions, each of the protrusions 102 has a cross-sectional area of approximately 0.005 square inch. In some constructions, the cross-sectional area of the protrusions 102 can comprise between 1% and 40% of the first surface 78. In some constructions, the cross-sectional area of the protrusions 102 can comprise between 1%, 5%, 10%, 15%, 20%, 25%, 30%, 35%, and 40% of the first surface 78. In some constructions, the cross-sectional area approaches or equals an area of the first surface 78. In some constructions, one of the protrusions 102 has a larger cross-sectional area than the other protrusion 102. Other constructions include various other numbers of protrusions 102, including a single protrusion 102, three protrusions 102, etc. Other constructions also include various other shapes, sizes, and cross-sectional areas than that illustrated. For example, in some constructions the HDMP 66 includes only a single protrusion 102, but one that has a large cross-sectional area. In some constructions, one of the protrusions 102 has a first cross-sectional area, and another protrusion 102 has a second, different cross-sectional area. Further, in some constructions the protrusions 102 may have a symmetrical cross-section. In other embodiments, the protrusions 102 may be non-symmetrical.

In some constructions, a coating is applied to the HDMP 66 after the HDMP 66 is formed to protect the HDMP 66 during subsequent steps of the embedded casting process 94. In many constructions, the coating preserves the structural integrity of the HDMP 66 by preventing oxidation during subsequent casting, described in further detail below. The coating can be made of any material capable of withstanding high temperatures as discussed above. For example, the coating can be made of ceramic, metal, cement, silicone, silicate or any other material or combination of materials capable of withstanding high temperatures. Exemplary cermet coatings may include but are not limited to tungsten carbide-cobalt, chromium carbide-nickel chromium, oxide ceramics like chromium oxide and alumina, molybdenum, iron, and nickel. Exemplary metal coatings may include but are not limited to tungsten carbide powder, nitride powder, zirconium oxide, diamond powder, cerium oxide, and aluminum oxide. Further, the coating can be applied using any process such as, for example, chemical vapor deposition, thermal spray, or brushing. In some constructions, the coating can have a thickness ranging from 25 microinches to 400 microinches. In some constructions, a second coating can be applied over the first coating, the second coating having a thickness ranging from 5 microinches to 60 microinches.

Figure 9:
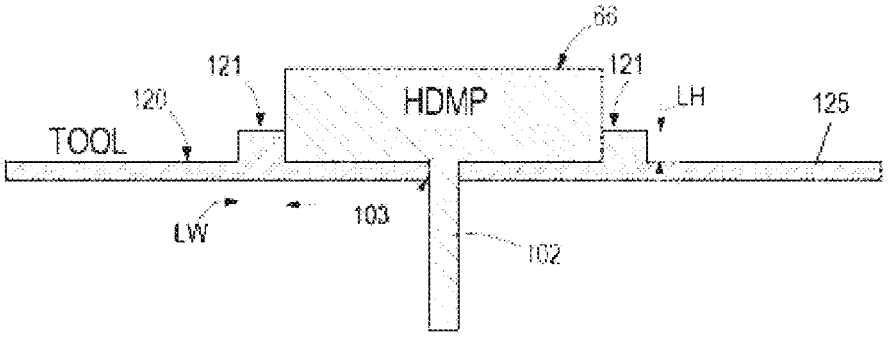
FIG. 9 is a schematic view of the HDMP during part of the process of FIG. 7, the HDMP being disposed in a tool.
Figure 10:
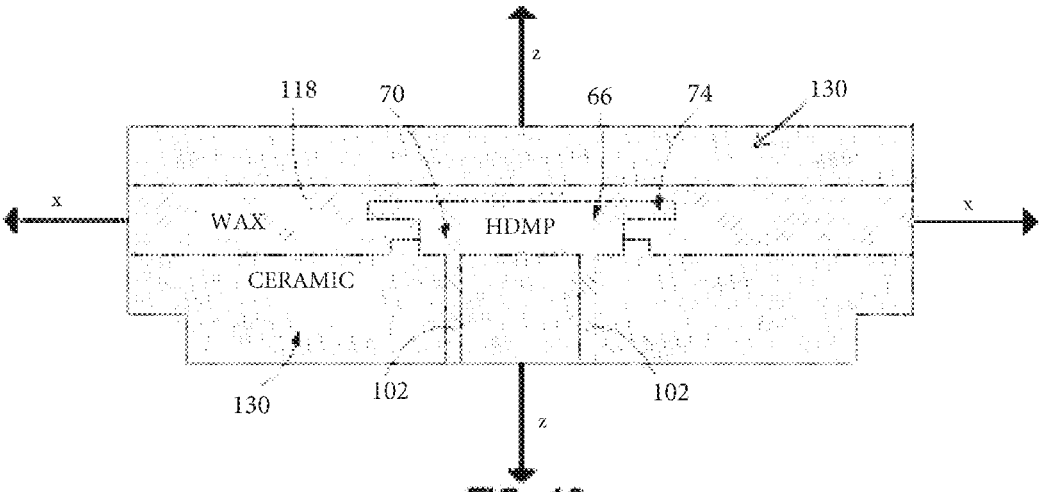
FIG. 10 is a schematic view of the HDMP during part of the process of FIG. 7, the HDMP embedded in wax and ceramic.

With reference to FIGS. 7, 9 and 10, the embedded casting process 94 further includes a second step 110 of placing the HDMP 66 into a wax injection mold, and a third step 114 of injecting wax 118 (e.g., investment wax) into the wax injection mold to partially embed the HDMP 66 in a wax shell or encasement.

For example, and with reference to FIG. 9, in the illustrated construction a tool 120 is placed in abutment with the HDMP 66. The tool 120 comprises a plate 125 having at least one aperture 103 configured to receive the protrusion 102 of the HDMP 66, and a lip, or step, or projection, or rim 121 configured to receive at least a part of the base portion 70 of the HDMP 66 (FIG. 9 is a schematic representation of the HDMP 66 and tool 120, and shows only a single protrusion 102, and aperture 103, although as described above the HDMP 66 may have two or more protrusions 102 and the tool 120 may have two or more apertures 103). The lip 121 can define a recess configured to receive the first surface 78 along with the part of the base portion 70 received by the lip 121, wherein the aperture 103 can be positioned within the defined recess. In many constructions, the lip 121 is continuous around the entire recess. In other embodiments, the lip 121 can be discontinuous and have multiple sections defining the recess. The lip 121 comprises a lip height "LH" extending away from the plate 125 towards the HDMP 66 and corresponding with the gap depth "GD". In the illustrated construction, the lip 121 is between 0.01 inch and 1 inches tall, although other values and ranges are also possible. For example, in some constructions, the lip 121 can be between 0.01 and 1.5 inches tall. In some constructions, the lip 121 can be 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1.0, 1.05, 1.1, 1.15, 1.2, 1.25, 1.3, 1.35, 1.4, 1.45 or 1.5 inches tall. Further, the lip 121 comprises a lip width "LW" extending in a direction parallel to the plate 125 and perpendicular to the lip height direction. The lip width "LW" corresponds with the gap width "GW". In the illustrated embodiment, the lip 121 is between 0.01 inch and 1 inch wide "LW", although other values and ranges are also possible. For example, in some constructions, the lip 121 can be between 0.01 and 1.5 inches wide. In some constructions, the lip 121 can be 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1.0, 1.05, 1.1, 1.15, 1.2, 1.25, 1.3, 1.35, 1.4, 1.45 or 1.5 inches wide. Further, in the illustrated construction, the lip 121 has a rectangular cross section. In other constructions, the lip 121 can take any cross sectional shape. For example, the lip 121 can have a triangular, cylindrical, conical, spherical, cubical or any suitable cross sectional shape.

When the wax 118 is injected into the tool 120, the wax 118 surrounds at least a portion of the HDMP 66, forming a wax shell and encasement, as shown in FIG. 10. This process at least partially embeds the HDMP 66 in the wax 118 in a precise and repeatable manner. As illustrated in FIG. 10, the wax 118 at least partially embeds the flange 74, and the top portion 67 of the HDMP 66, whereas the two protrusions 102, and a part of the base portion 70, which was received by the lip 121 are left exposed or disposed outside of (projecting out of) the wax 118 creating the gap 86. In some constructions, only a portion of the base portion 70 can be exposed outside of the wax 118. In other constructions, the entire base portion 70 can be exposed outside the wax. In other constructions, the entire base portion 70 and part of the top portion can be exposed outside the wax 118. Once the wax 118 has been injected, the process includes removing the tool 120, such that the gap 86 is formed between the portion of the HDMP 66 that was received in the lip 121 and the wax 118.

With reference to FIGS. 7 and 10, the embedded casting process 94 further includes a fourth step 122 of adding wax pieces to a wax setup, and a fifth step 126 of coating the wax setup with a ceramic material, after removing the tool 120. As illustrated in FIG. 10, for example, the wax 118 forms at least one wax piece of a wax assembly for the golf club head 10. In some constructions, the wax assembly has a main wax body. Each wax piece is attached to the main wax body, forming the overall wax assembly that is used to form the golf club head body 14. In some constructions, a cone or cup (not shown) is attached to the wax assembly on a top of the wax assembly. This cone includes an opening through which molten material may be poured during a later step.

During the fifth step 126, the wax assembly is dipped into a liquid ceramic slurry to form a ceramic shell 130 (FIG. 10) over the wax assembly. The cone portion of the wax assembly is left open on top. The wax assembly is provided with several layers of ceramic coating to form the ceramic shell 130, since several coats of ceramic achieves a desired strength that is sufficient for holding molten material in a later step of pouring in molten material into the ceramic shell 130. Each coating is dried before the next coating is applied. As illustrated in FIG. 10, during this step, the HDMP 66 is at least partially embedded in a combination of the wax 118 and the ceramic shell 130. The two protrusions 102 can be encased in the ceramic shell 130, but the protrusion 102 are not penetrating through the ceramic shell 130. Further, as illustrated in FIG. 10, the gap 86, created by the lip 121 receiving the base portion 70, can be entirely filled in by the ceramic shell 130.

With reference again to FIG. 7, the embedded casting process 94 further includes a sixth step 134 of melting and removing the wax 118, forming a hollow region between the ceramic and the HDMP 66. In the illustrated construction, after the ceramic shell 130 has dried, the wax 118 is melted by turning over the wax assembly and heating the wax assembly. During this sixth step 134, and as described further herein, the HDMP 66 is held rigidly in place in the ceramic shell 130 via the ceramic filled gap 86 and/or the protrusions 102 within the ceramic, and does not therefore translate or rotate relative to the ceramic shell 130.

With continued reference to FIG. 7, the embedded casting process 94 further includes a seventh step 138 of pre-heating the ceramic shell 130, and an eighth step 142 of pouring molten material (e.g., metal) into the hollowed region between the ceramic shell 130 and the HDMP 66 (e.g., through the opening in the cone described above). The molten material will form at least a portion of the golf club head body 14. The chosen pre-heated temperature depends, for example, on the material used for the golf club head body 14. During the eighth step 142 the molten material at least partially embeds the HDMP 66, and as the molten material cools and solidifies, the HDMP 66 becomes an integral part of the final casting of the golf club head body 14 (i.e., becomes integrally embedded in the club head body 14).

In some constructions, the molten material is a stainless steel alloy, aluminum alloy, titanium alloy, or other low density, high strength metal, although other constructions include different materials. In some constructions, the molten material is a polymer plastic, a thermoplastic, a thermoset, or other similar material is melted and poured into the ceramic shell 130. In some constructions, the molten material is a steel-based material (e.g., 17-4 PH stainless steel, NITRONIC™ 50 austenitic stainless steel, maraging steel or other types of stainless steel), a titanium-based material such as Ti-9S, and Ti-6-4), an aluminum based material (e.g., a high strength aluminum alloy or a composite aluminum alloy coated with high strength alloy) or any combination thereof. The HDMP 66 may have a higher melting point than the molten material, such that the HDMP 66 does not melt or deform when in contact with the molten material forming the golf club head body 14.

As described above, the use of the two protrusions 102 with axes 106, 108 that are offset from one another inhibits or prevents the HDMP 66 from translating or rotating (e.g., twisting) relative to the ceramic shell 130 during the process 94. In particular, the density of the molten material and the kinetic energy imparted by gravity and/or centrifugal motion tends to produce a force on the HDMP 66 during the eighth step 142. The protrusions 102 advantageously resist this force and hold the HDMP 66 in place, such that a precise positioning of the HDMP 66 and the resultant center of gravity or CG 52 is not adversely affected. In the same or other constructions, the ceramic filled gap 86 can inhibit or prevent the HDMP 66 from translating along or in the direction of the x or y-axis. Further, the ceramic filled gap 86 can inhibit or prevent the HDMP 66 from rotating about the z-axis. The ceramic filled gap 86 can be in lieu of the two protrusions 102 or in addition to the two protrusions 102.

With continued reference to FIG. 7, the embedded casting process 94 further includes a ninth step 146 of removing the ceramic shell 130. The ceramic shell 130 is removed, for example, by physically breaking the ceramic shell 130 after the molten metal has cooled, such that the ceramic shell 130 shatters and falls off of the cooled metal and off of the HDMP 66. In some constructions, the ceramic shell 130 is removed by mechanical means such as vibration, impact, sand blast or fine tool work.

With continued reference to FIG. 7, the embedded casting process 94 further includes a tenth step 150 of separating cast parts from a larger assembly of cast parts. For example, the golf club head 10, a series of golf club heads 10, and/or one or more golf clubs overall, may be formed from a plurality of cast parts, such as one or more of the cast golf club head bodies 14 and HDMPs 66 described above. Once all of these cast parts are created as previously described, the parts are separated for further processing. In an eleventh step 154, all gates and sprues from each cast part are removed.

Figure 11:
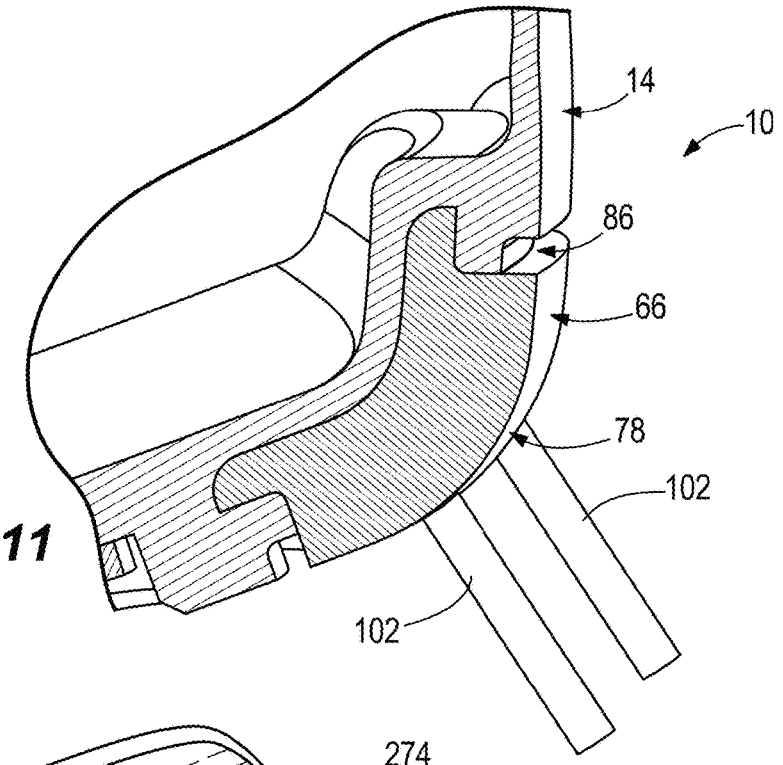
FIG. 11 is a partial, cross-sectional view of a portion of the golf club head of FIGS. 1-3, showing the HDMP during part of the process of FIG. 7, the HDMP with the two cylindrical posts.

FIG. 11 illustrates one of the cast golf club head bodies 14 and HDMPs 66 after the tenth step 150. With the ceramic shell 130 having been removed, the first surface 78, as well as the two protrusions 102, are exposed along an outside of the golf club head 10 and the golf club head body 14. The HDMP 66 is held rigidly in place, having been cast into the golf club head body 14, with the gap 86 having been formed between the HDMP 66 and the golf club head body 14.

With reference to FIGS. 7 and 11, the embedded casting process 94 further includes a twelfth step 158 of removing the two protrusions 102. The two protrusions 102 are removed, for example, by grinding the protrusions 102 down toward the first surface 78, and then polishing the first surface 78 until the first surface 78 is smooth. Other constructions include different manners of removing the protrusions 102, including laser removal, machining, and electrical discharge machining (EDM). The presence of the gap 86 advantageously allows the protrusions 102 to be removed without the concern of scalloping the golf club head body 14.

With reference to FIG. 7, the embedded casting process 94 further includes a thirteenth and final step 162 of finishing the cast part or parts. For example, and with reference to FIG. 6, once the protrusions 102 have been removed, the gap 86 is filled in with the filler material 90 (e.g., paint, epoxy, rubber, silicon, or other flexible materials).

Without the gap 86 and/or without the filler material 90, the HDMP 66 and the golf club head body 14 might otherwise contact one another along the outside of the golf club head body 14, i.e., along an exposed surface visible to a user. Contact at this junction between the golf club head body 14 and the HDMP 66 might cause the material (e.g., metal) in this region to become discolored in an undesirable way. For example, the juncture of the HDMP 66 and the golf club head body 14 along the outside of the golf club head body 14 is typically hotter than the rest of the golf club head body 14, at least for a period of time. This temperature difference may cause a visually undesirable appearance at the juncture due to oxidation between the HDMP 66 and the material of the golf club head body 14. Creation of the gap 86, as well as use of the filler material 90, thereby provides a means to separate the first surface 78 of the HDMP 66 from the golf club head body 14 in this region, and to prevent and/or hide any discoloration along the exterior surface of the finished golf club head 10. Additionally, the ceramic filled gap 86 can inhibit or prevent the HDMP 66 from translating along or in the direction of the x or the y-axis relative to the ceramic shell 130 during the casting process 94. Further, the ceramic filled gap 86 can inhibit or prevent the HDMP 66 from rotating about the z-axis relative to the ceramic shell 130 during the casting process 94.

The embedded casting process 94 described above advantageously positions the center of gravity or CG 52 of the golf club head 10. For example, The HDMP 66 has a higher density than the molten material that forms the golf club head body 14. Thus, when the HDMP 66 is cast into the golf club head body 14, the HDMP 66 causes the center of gravity or CG 52 to be moved to a desired location (e.g., at a lower, rearward location as illustrated in FIG. 3). In some constructions, the HDMP 66 is heavy enough to account for between 1/7 to 1/9 of a total mass of the golf club head 10 after being cast in place, although other constructions include different values and ranges.

The embedded casting process 94 described above also advantageously maximizes the lower, rearward placement of the HDMP 66. For example the embedded casting process 94 is able to move the center of gravity or CG 52 down and back much farther than currently used methods of placing an HDMP. Additionally, the embedded casting process 94 minimizes supporting structures around the HDMP 66. This allows weight not used in such supporting structures to be redistributed elsewhere. The embedded casting process 94 also eliminates welding, brazing, swaging, adhesive application, drilling and tapping and other time and labor-intensive operations. The embedded casting process 94 also provides more design freedom for placement of the HDMP 66, as compared to other methods for joining an HDMP to a club head body that typically impose restrictions on positioning.

Figure 12:
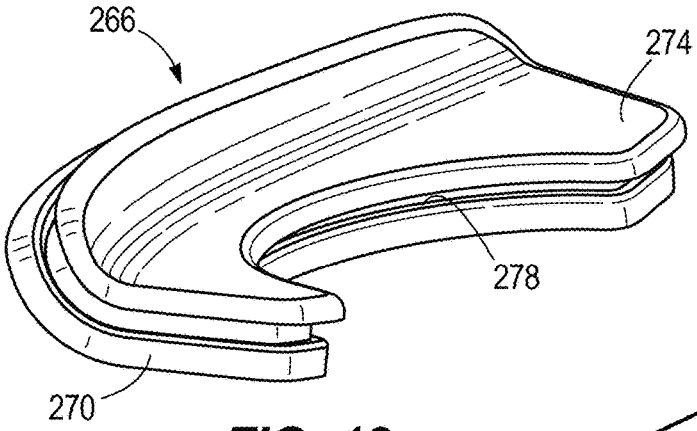
FIG. 12 is a perspective view of an HDMP according to another construction.
Figure 13:
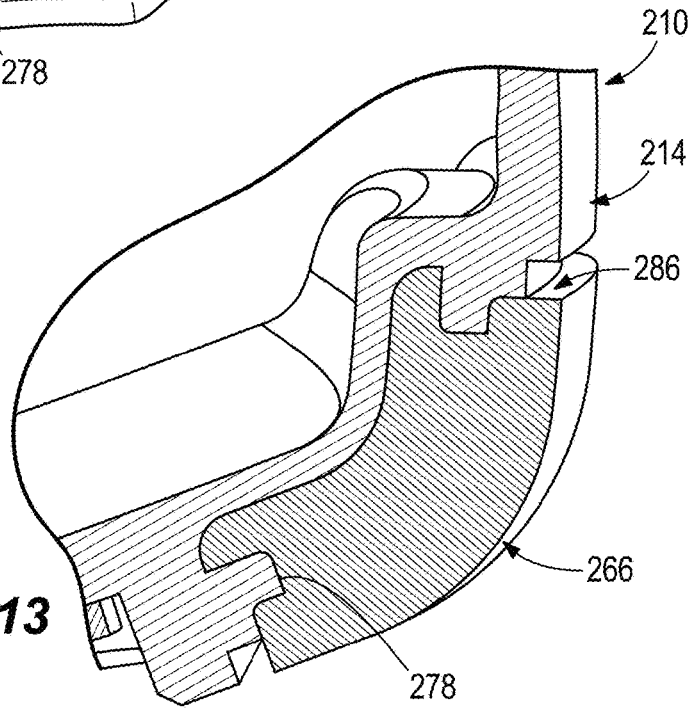
FIG. 13 is a partial, cross-sectional view of a portion of a golf club head, showing the HDMP of FIG. 12 coupled to a body of the golf club head.

As described above, the HDMPs themselves may have various shapes and sizes, and may include various numbers, sizes, and shapes of protrusions. For example, FIGS. 12 and 13 illustrate a club head 210 and an HDMP 266 according to another construction. The HDMP 266 is made of tungsten, tantalum, rhenium, osmium, iridium, or platinum, although other constructions include different materials. The HDMP 266 includes a first flange 270 and a second flange 274. The first and second flanges 270, 274 define a groove 278 that extends around at least a portion of a perimeter of the HDMP 266. As illustrated in FIG. 12, once the HDMP 266 has been cast using the embedded casting process 94, a portion of a club head body 214 on the club head 210 extends into the groove 278. Use of the groove 278 provides added support and further helps to secure the HDMP 266 to the golf club head body 214. As illustrated in FIG. 13, a gap 286 is also provided for insertion of a filler material, similar to the gap 86 described above, so as to inhibit or prevent the onset of discoloration. Additionally, similar to gap 86, ceramic filled gap 286 can inhibit or prevent the HDMP 266 from translating along or in the direction of the x or the y-axis relative to the ceramic shell 130 during the casting process 94. Further, the ceramic filled gap 286 can inhibit or prevent the HDMP 266 from rotating about the z-axis relative to the ceramic shell 130 during the casting process 94.

Figure 14:
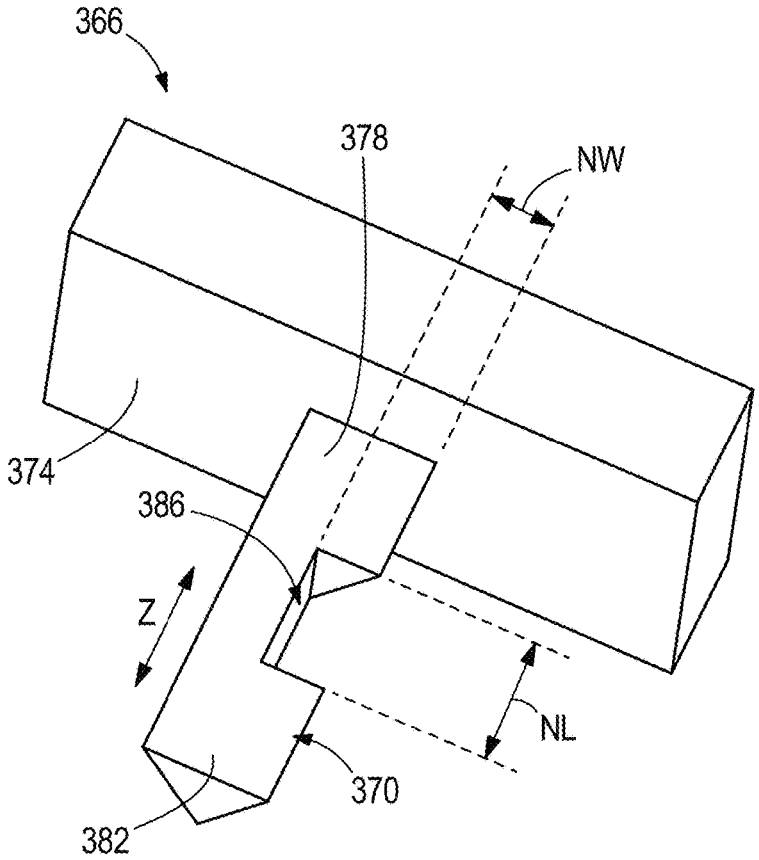
FIGS. 14 and 15 are perspective views of an HDMP according to another construction, the HDMP having a non-cylindrical protrusion and a notch in the protrusion.
Figure 15:
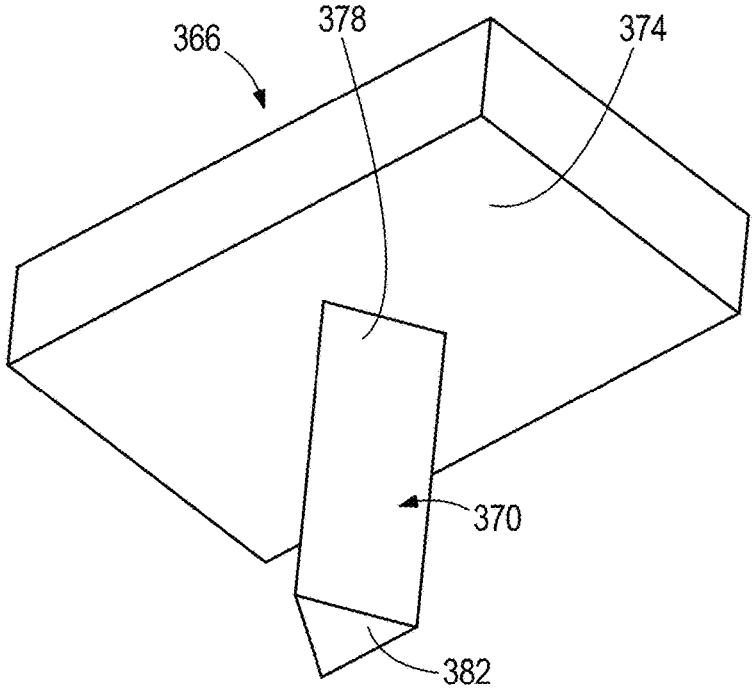

FIGS. 14 and 15 illustrate an HDMP 366 according to yet another construction. The HDMP 366 is made of tungsten, tantalum, rhenium, osmium, iridium, or platinum, although other constructions include different materials. The HDMP 366 includes a protrusion 370 that extends (e.g., perpendicularly) from a surface 374. The protrusion 370 is a non-cylindrical protrusion, and has a generally triangular-shaped cross-section, although other constructions include different cross-sections, including square, hexagonal, etc. The protrusion 370 includes a first end 378 at the surface 374, a second end 382 disposed opposite the first end 378 and distally away from the surface 374, and a notch 386 disposed along a side of the protrusion 370 between the first and second ends 378, 382. The notch 386 defines a cut-out region on the protrusion 370. In some constructions, the notch 386 cuts away a semi-circular or other-shaped piece from the protrusion 370. With reference to FIG. 14, the notch 386 has a notch length "NL" as measured along a direction "Z" defined by the protrusion 370. The notch length "NL" is at least 0.005 inch, although other constructions include different values and ranges. For example, in some constructions, the notch length "NL" is at least 0.0075 inch. In some constructions, the notch length "NL" is at least 0.010 inch. In some constructions, the notch has a notch width "NW" as measured along a direction perpendicular to the notch length "NL" of at least 0.005 inch, although other values and ranges are also possible. For example, in some constructions, the notch width "NW" is at least 0.0075 inch. In some constructions, the notch width "NW" is at least 0.010 inch.

The single protrusion 370 functions similarly to the combination of the two protrusions 102 described above. For example, during the embedded casting process 94, the protrusion 370 is embedded at least partially in the ceramic shell 130. Because of the non-cylindrical shape of the protrusion 370, the protrusion 370 is less likely to slide out of the ceramic shell 130 or to translate or rotate (e.g., twist) relative to the ceramic shell 130 than with a single cylindrical protrusion. Additionally, the notch 386 provides a further grip onto the ceramic shell 130 that inhibits or prevents the protrusion 370 from translating or rotating relative (e.g., twisting) relative to the ceramic shell 130 (e.g. from moving along the direction "Z" illustrated in FIG. 14). The notch 386 is free from the wax 118 during the embedded casting process 94 (e.g., is disposed away from an outside surface of the wax 118), and receives the ceramic material that forms the ceramic shell 130. In some constructions, more than one notch 386 is provided on the non-cylindrical protrusion 370. In some constructions, the non-cylindrical protrusion 370 does not include a notch 386. In some constructions, the notch 386 is located at a different location along the protrusion 370 than that shown (e.g., is located at the second end 382). In the same or other constructions, a gap, similar to gap 86, can be used to inhibit or prevent the HDMP 366 from translating along or in the direction of the x or y-axis. Further, the ceramic filled gap can inhibit or prevent the HDMP 366 from rotating about the z-axis. The gap can be in lieu of the protrusion 370 and/or the notch 386 or in addition to the protrusion 370 and/or the notch 386.

Figure 16:
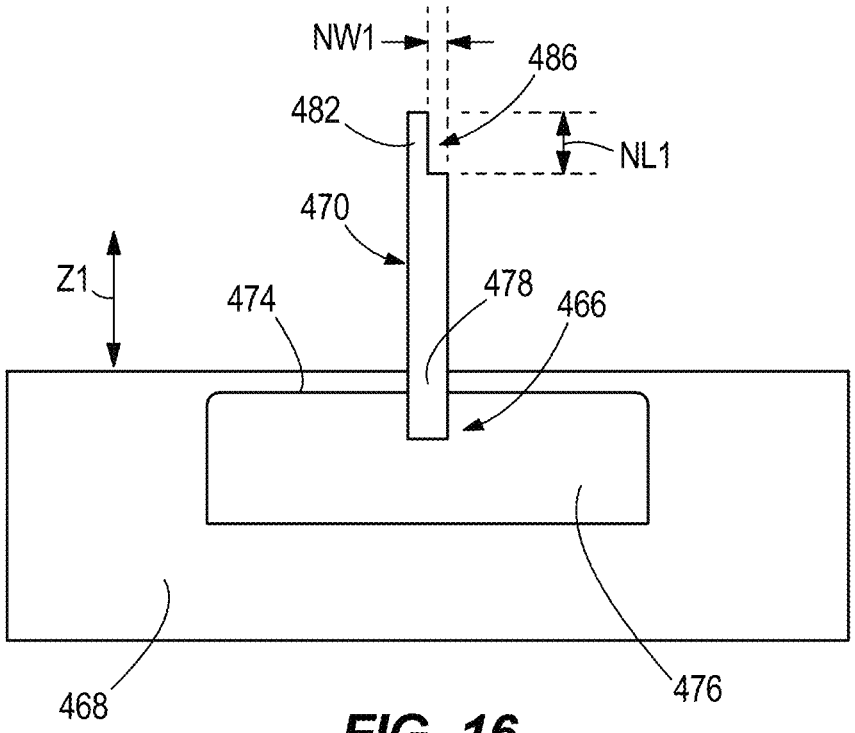
FIG. 16 is a schematic view of an HDMP according to another construction, the HDMP partially embedded in a cast material and having a protrusion and a notch at an end of the protrusion.

FIG. 16 illustrates an HDMP 466 according to yet another construction, cast into a material 468 (e.g., 17-4 stainless steel). The HDMP 466 is made of tungsten, tantalum, rhenium, osmium, iridium, or platinum, although other constructions include different materials. The HDMP 466 includes a cylindrical protrusion 470 that extends (e.g., perpendicularly) from a surface 474 of a base portion 476 (FIG. 16 is a schematic representation; in some constructions the HDMP 466 also includes, for example, a flange similar to the flange 74 described above). The protrusion 470 includes a first end 478 at the surface 474 and a second end 482 disposed opposite the first end 478 and distally away from the surface 474. The cylindrical protrusion 470 also includes a notch 486. The notch 486 is disposed along a side of the protrusion 470 at the second end 482. The notch 486 defines a cut-out region on the protrusion 470. Similar to the notch 386, the notch 486 provides a grip onto the ceramic shell 130 during the embedded casting process 94, and inhibits or prevents the HDMP 466 from translating or rotating (e.g., twisting) relative to the ceramic shell 130. In the same or other constructions, a gap, similar to gap 86, can be used to inhibit or prevent the HDMP 466 from translating along or in the direction of the x or y-axis. Further, the ceramic filled gap can inhibit or prevent the HDMP 466 from rotating about the z-axis. The gap can be in lieu of the protrusion 470 and/or the notch 486 or in addition to the protrusion 470 and/or the notch 486. In some constructions, the protrusion 470 includes more than one notch 486. In some constructions, more than one protrusion 470 is provided, at least one of which includes the notch 486. The notch 486 defines a cut-out region on the protrusion 470. In some constructions, the notch 486 cuts away a semi-circular or other-shaped piece from second end 482 of the protrusion 474. The notch has a notch length "NL1" as measured along a direction "Z1" defined by the protrusion 470. The notch length "NL1" is 0.005 inch, although other constructions include different values and ranges. For example, in some constructions, the notch length "NL1" is at least 0.0075 inch. In some constructions, the notch length "NL1" is at least 0.010 inch. In some constructions, the notch has a notch width "NW1" as measured along a direction perpendicular to the notch length "NL1" of at least 0.005 inch, although other values and ranges are also possible. For example, in some constructions, the notch width "NW1" is at least 0.0075 inch. In some constructions, the notch width "NW1" is at least 0.010 inch.

Figure 17:
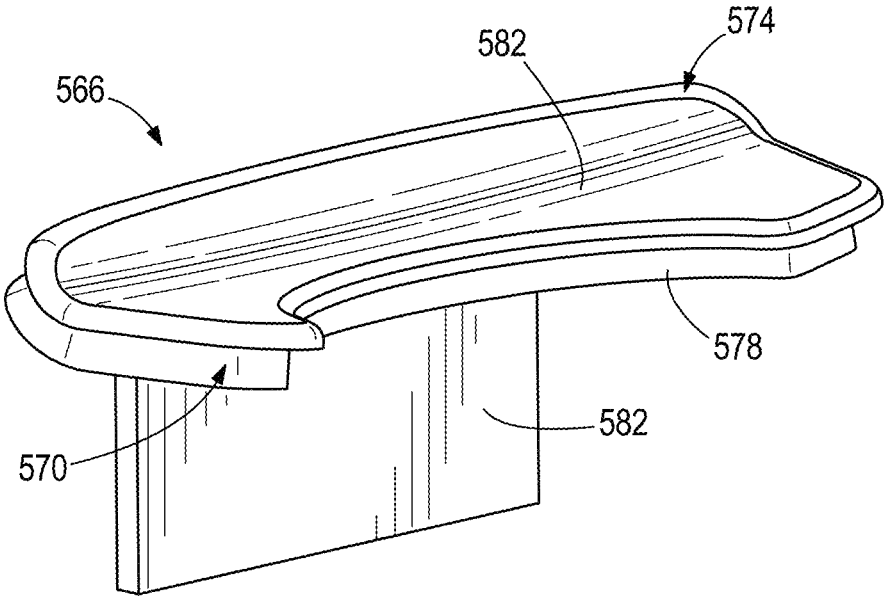
FIG. 17 is a perspective view of an HDMP according to another construction, the HDMP having a protrusion in the form of an elongate bar.
Figure 18:
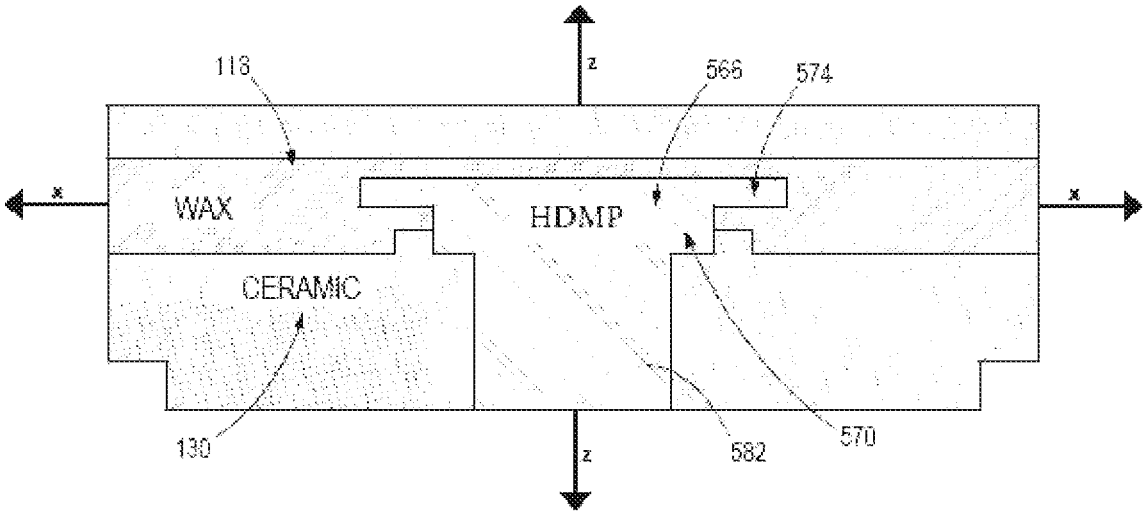
FIG. 18 is a schematic view of the HDMP of FIG. 17, showing the HDMP embedded in wax and ceramic.

FIGS. 17 and 18 illustrate an HDMP 566 according to yet another construction. The HDMP 566 is made of tungsten, tantalum, rhenium, osmium, iridium, or platinum, although other constructions include different materials. Similar to the HDMP 66, the HDMP 566 includes a base portion 570, a flange 574, a first surface 578 on the base portion 570, and an opposite, second surface 582 on the flange 574. The HDMP 566 also includes a protrusion 586 that extends (e.g., perpendicularly) from the first surface 578. The protrusion 586 is an elongate bar. As illustrated in FIG. 18, during the embedded casting process 94 the protrusion 586 is embedded in the ceramic shell 130. Because the protrusion 586 is an elongate bar, the HDMP 566 is inhibited or prevented from translating or rotating (e.g., twisting) relative to the ceramic shell 130. In some constructions, the HDMP 566 includes more than one protrusion 586. In some constructions the protrusion 586 includes one or more notches (e.g., a notch like notch 386 or notch 486). In the same or other constructions, a gap, similar to gap 86, can be used to inhibit or prevent the HDMP 566 from translating along or in the direction of the x or y-axis. Further, the ceramic filled gap can inhibit or prevent the HDMP 566 from rotating about the z-axis. The gap can be in lieu of the protrusion 586 or in addition to the protrusion 586.

Figure 19:
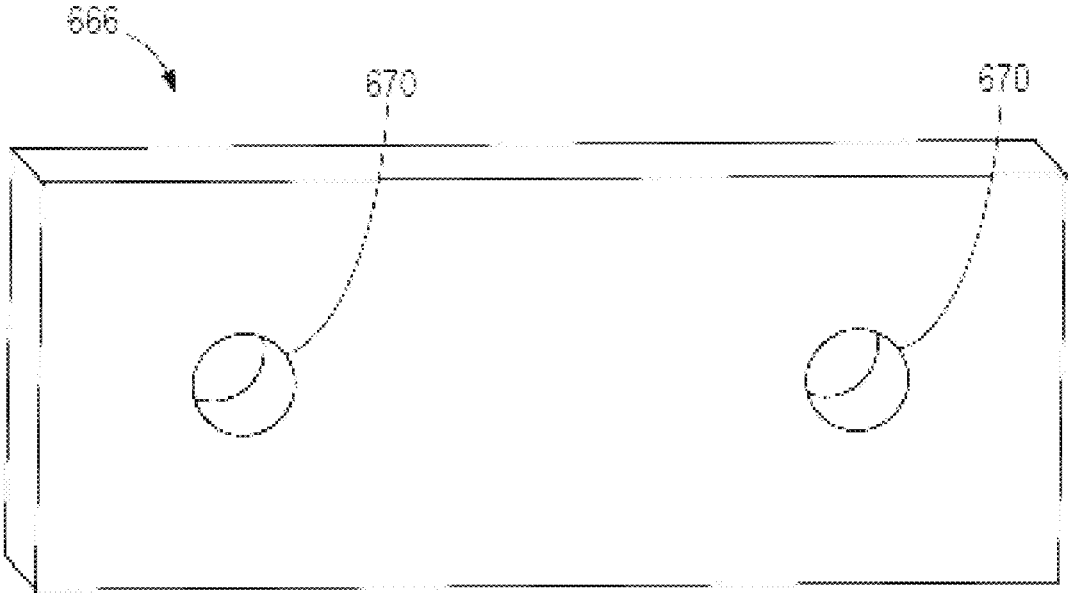
FIG. 19 is a schematic, perspective view of an HDMP according to another construction, the HDMP having through-holes extending therethrough.

FIG. 19 illustrates an HDMP 666 according to yet another construction. The HDMP 666 includes at least one through-hole 670 extending therethrough. In the illustrated construction, the HDMP 666 includes two through-holes 670, although other constructions include different numbers and arrangements of through-holes 670. For example, in some constructions the HDMP 666 includes a single through-hole 670. In some constructions, the HDMP 666 includes more than two through-holes 670. In the illustrated construction, the through-holes 670 are cylindrical, having a constant diameter. In some constructions, the through-holes 670 have varying diameters. The through-holes 670 are exposed to the flow of the molten material (e.g., metal) during the embedded casting process 94. The through-holes 670 thus provide openings into which the molten material (e.g., metal) flows during the embedded casting process 94. When the molten material cools and solidifies, the HDMP 666 is supported and gripped by solidified material in the through-holes 670.

Figure 20:
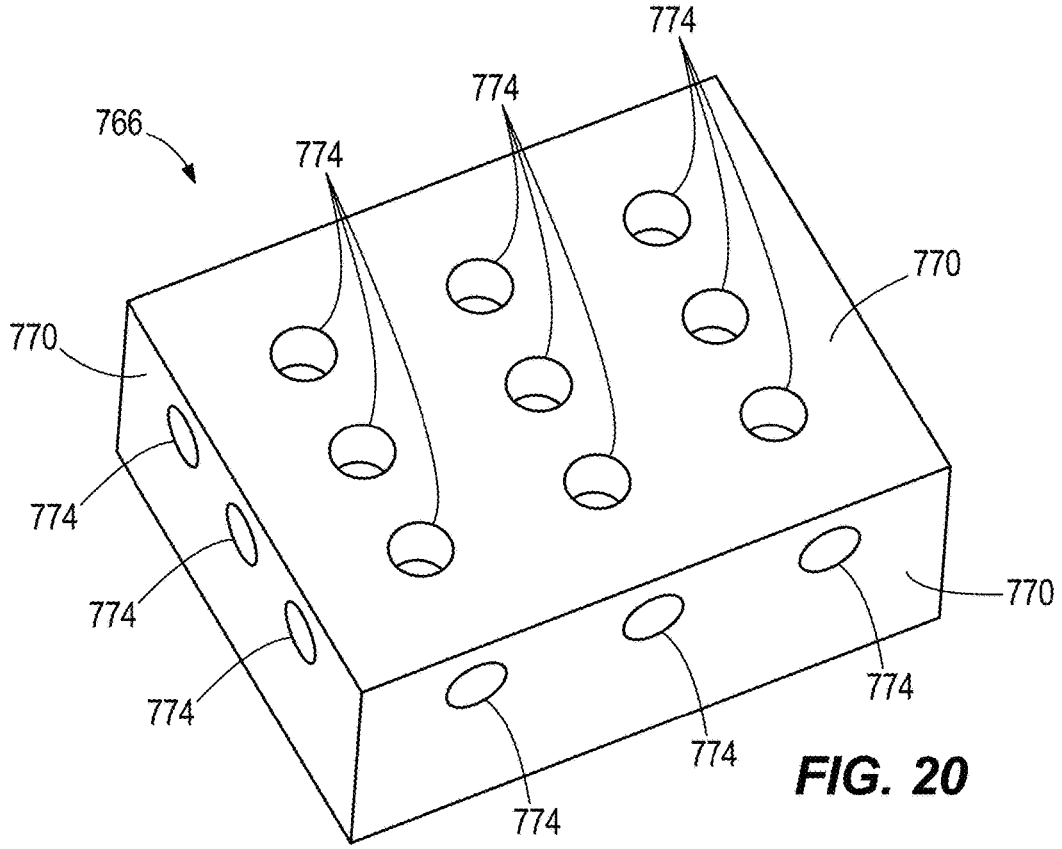
FIGS. 20 and 21 are schematic, perspective views of an HDMP according to another construction, the HDMP having depressions along surfaces of the HDMP.
Figure 21:
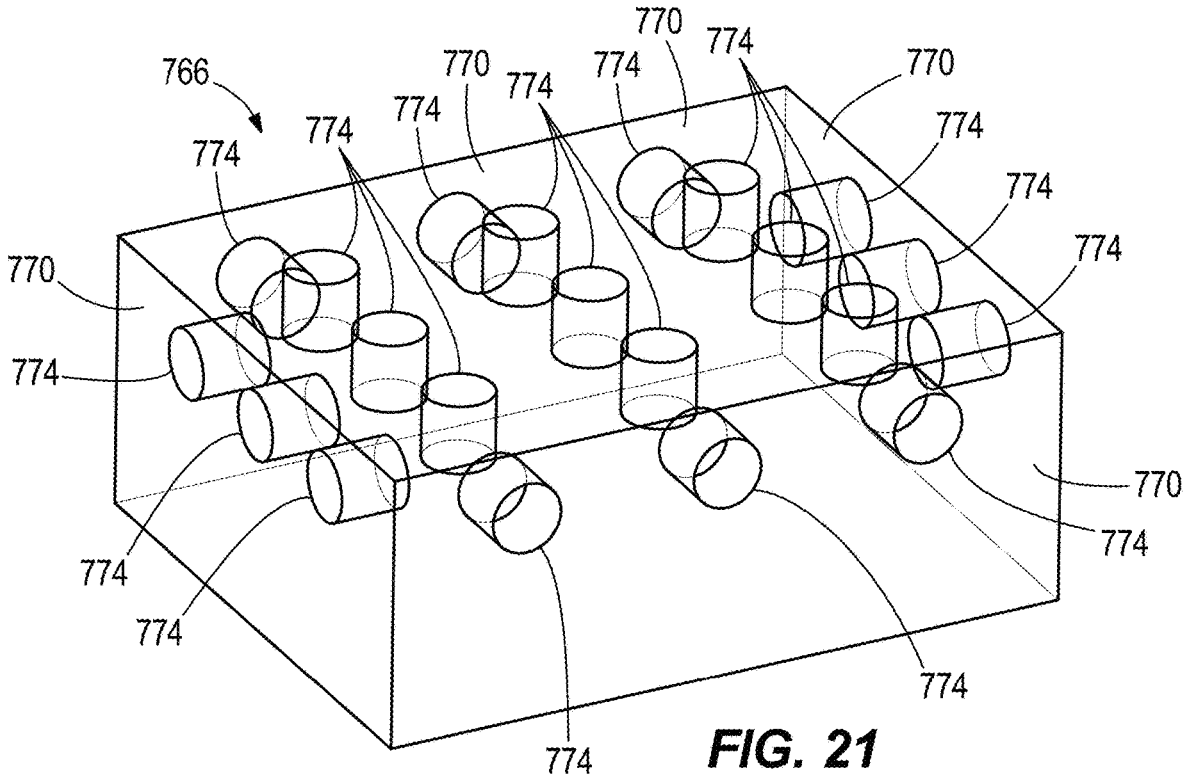

FIGS. 20 and 21 illustrate an HDMP 766 according to yet another construction. The HDMP 766 includes at least one outer surface 770, and at least one depression 774 (e.g., blind hole) disposed on the at least one outer surface 770. In the illustrated construction, the HDMP 766 includes twenty one depressions 774 disposed on five different outer surfaces 770, although other constructions include different numbers and arrangements of depressions 774. For example, in some constructions the HDMP 766 includes one or more depressions 774 disposed only on a single outer surface 770. In some constructions, the HDMP 766 includes a single depression 774 on a plurality of different outer surfaces 770. In the illustrated construction, the depressions 774 are cylindrical, having a constant diameter. In some constructions, the depressions 774 have varying diameters. In some constructions, the depressions 774 are bowl-shaped, conical, or other-shaped to provide a depressed area or region non-continuous with the surface 770. The depressions 774 are exposed to the flow of the molten material (e.g., metal) during the embedded casting process 94. The depressions 774 thus provide openings into which the molten material flows during the embedded casting process 94. When the molten material cools and solidifies, the HDMP 766 is supported and gripped by the solidified material in the depressions 774.

In some constructions, an HDMP includes both at least one through-hole 670 as well as at least one depression 774. In some constructions, an HDMP includes at least one protrusion (e.g., a protrusion 102, 370, 470, or 586 as described above), as well as at least one through-hole 670 and/or at least one depression 774. In some constructions, an HDMP has an as-formed surface. In some constructions, an HDMP has a surface processed to a desired roughness. In some constructions, an HDMP has a coating applied to enhance adhesion to the wax 118 and/or to the ceramic shell 130 during the embedded casting process 94 described above. In some constructions, an HDMP includes at least two different protrusions (e.g., a protrusion 102 and a protrusion 370). In some constructions, a golf club head includes more than one HDMP that is cast in place using the embedded casting process 94 described above.

Figure 22:
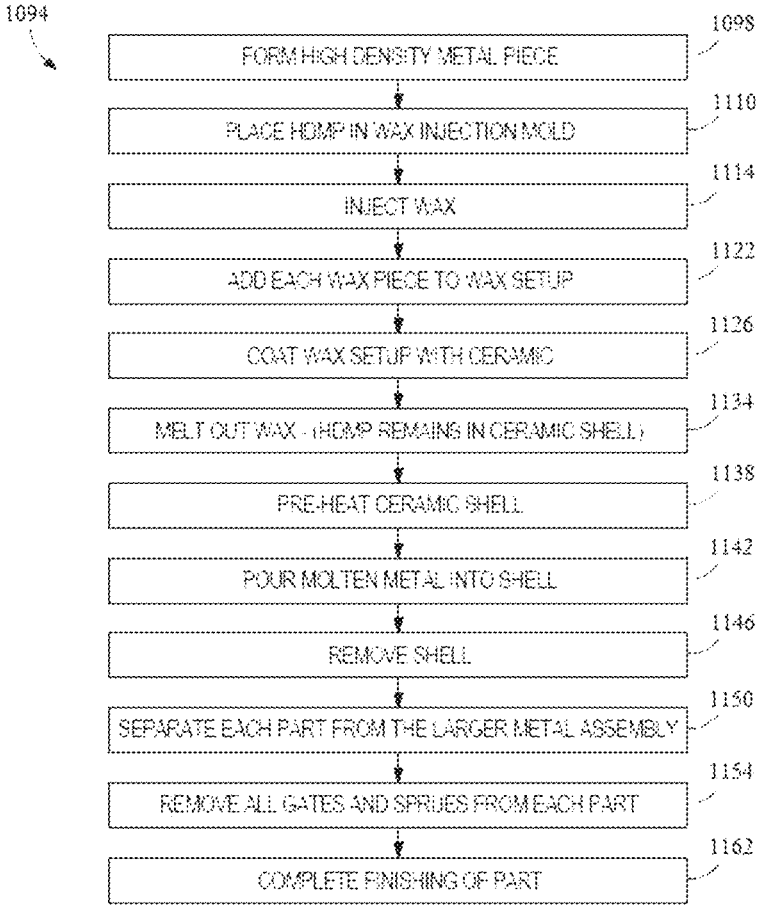
FIG. 22 is a flowchart of another embedded casting process for forming the golf club head of FIGS. 1-3 and for coupling an HDMP to the golf club head body.

FIG. 22 illustrates another embedded casting process 1094 for forming the golf club head 10 and for coupling the HDMP 866 to the golf club head body 14 as illustrated in FIGS. 1-6. The embedded casting process 1094 illustrated in FIG. 22 is similar in many respects to the embedded casting process 94 illustrated in FIG. 7, except the embedded casting process 1094 illustrated in FIG. 22 is devoid of the step including removing the HDMP protrusions from the part. The embedded casting process 1094 includes a first step 1098 of forming the HDMP 866. The HDMP 866 is formed, for example, by machining, casting, metal injection molding, direct laser sintering, powdered metal forming processes, or other appropriate processes known to those skilled in the art.

Figure 23:
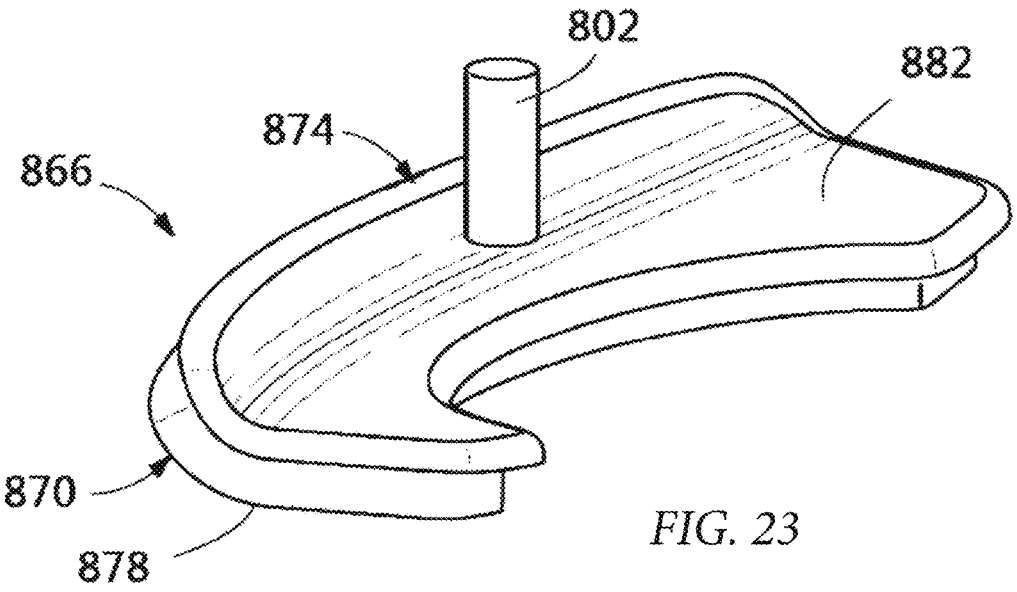
FIG. 23 is a perspective view of the HDMP during part of the process of FIG. 22, the HDMP having a protrusion in the form a cylindrical post.

With reference to FIG. 23, the HDMP 866 is similar to HDMP 66, except the HDMP 866 is devoid of any protrusions extending from the first surface 878 of the base portion 870 of the HDMP 866 as opposed to the protrusions 102 on the first surface 78 of HDMP 66. However, in the illustrated construction, the HDMP 866 includes a single protrusion 802 extending from the second surface 882 of the HDMP 866. The protrusion 802 may extend (e.g., perpendicularly) from the second surface 882 of the HDMP 866, and may be integrally formed as part of the HDMP 866. In the illustrated construction, the protrusion 802 extends between 0.2 and 10 inches away from the second surface 882, although other constructions include different values and ranges. In some constructions, the protrusion 802 extends between 0.2 and 1 inch away from the second surface 882. In some constructions, the protrusion 802 extends between 0.2 and 5 inches away from the second surface 882. In some constructions, the HDMP 866 may not include any protrusions 802. In some constructions the HDMP 866 includes a plurality of protrusions 802. In other constructions, the HDMP 866 can include two protrusions 802 extending from the second surface along axes that are parallel to one and other. In other constructions, the protrusions 802 can comprise a notch (not shown) similar to the notch 386 described above with reference to protrusion 370 of HDMP 366.

The protrusion 802 also has a cross-sectional area. In the illustrated construction, the protrusion 802 has a circular cross-section defining a cross-sectional area between 0.005 square inch and 0.010 square inch, although other constructions can include different values and ranges. In some constructions, the protrusion 802 has a cross-sectional area of between 0.005 square inch and 0.015 square inch. In some constructions, the protrusion 802 has a cross-sectional area of approximately 0.005 square inch. In some constructions, the cross-sectional area approaches or equals an area of the first surface 878. Additionally, other constructions may include a protrusion 802 having a different cross-section, including triangular, square, hexagonal, etc. Further, in some constructions the protrusion 802 may have a symmetrical cross-section. In other embodiments, the protrusion 802 may be non-symmetrical.

In some constructions, a coating is applied to the HDMP 866 after the HDMP 866 is formed to protect the HDMP 866 during subsequent steps of the embedded casting process 1094. In many constructions, the coating preserves the structural integrity of the HDMP 866 by preventing oxidation during subsequent casting, described in further detail below. The coating can be made of any material capable of withstanding high temperatures as discussed above. For example, the coating can be made of ceramic, metal, cermet, silicone, silicate or any other material or combination of materials capable of withstanding high temperatures. Exemplary cermet coatings may include but are not limited to tungsten carbide-cobalt, chromium carbide-nickel chromium, oxide ceramics like chromium oxide and alumina, molybdenum, iron, and nickel. Exemplary metal coatings may include but are not limited to tungsten carbide powder, nitride powder, zirconium oxide, diamond powder, cerium oxide, and aluminum oxide. Further, the coating can be applied using any process such as, for example, chemical vapor deposition, thermal spray, or brushing. In some constructions, the coating can have a thickness ranging from 25 microinches to 400 microinches. In some constructions, a second coating can be applied over the first coating, the second coating having a thickness ranging from 5 microinches to 60 microinches.

Figure 24:
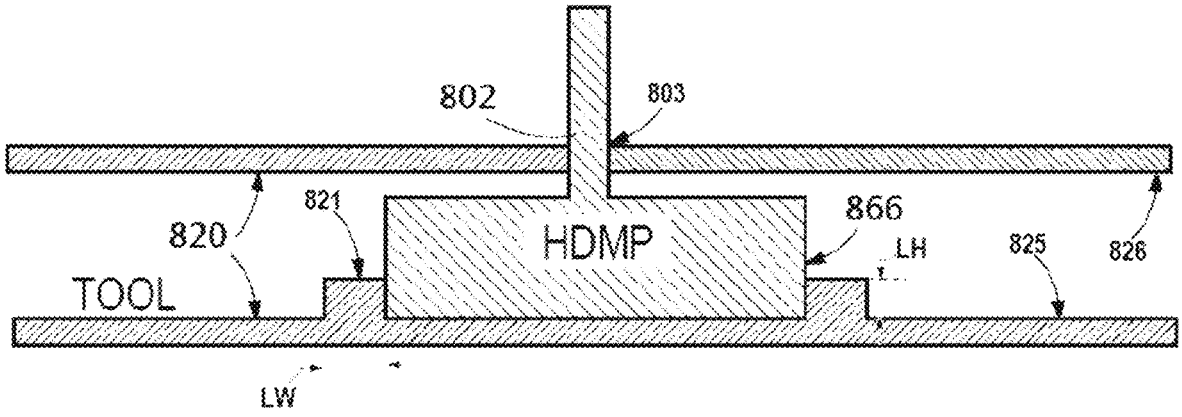
FIG. 24 is a schematic view of the HDMP during part of the process of FIG. 22, the HDMP being disposed in a tool.
Figure 25:
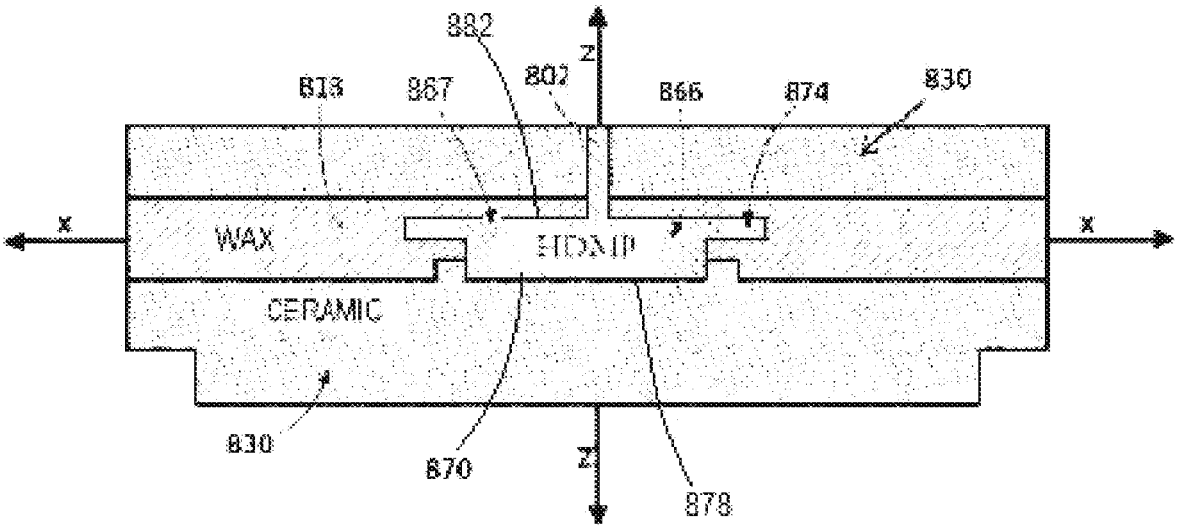
FIG. 25 is a schematic view of the HDMP during part of the process of FIG. 22, the HDMP embedded in wax and ceramic.

With reference to FIGS. 22, 24 and 25, the embedded casting process 1094 further includes a second step 1110 of placing the HDMP 866 into a wax injection mold, and a third step 1114 of injecting the wax 818 (e.g., investment wax) into the wax injection mold to partially embed the HDMP 866 in a wax shell or encasement. The wax injection mold creates a gap 886 between the outer surface of the base portion 870 and the wax 818. The outer surface of the base portion 870 being the portion of the HDMP 866 which will be exposed to the exterior of the golf club head 10 when the casting process 1094 is completed. In many constructions, the gap 866 can extend entirely around the base portion 870. In some constructions, the gap 866 can extend partially around the base 870. In other constructions, the gap 886 can include one or more portions extending at least partially around the base portion 870 creating a plurality of gap sections. For example, referring to FIG. 30, the gap can include a single first gap portion 87 extending around approximately half of the base portion 70. For further example, referring to FIG. 31, the gap 86 can include a first gap portion 87 positioned at a corner 71 of the base portion 70, a second gap portion 88 positioned at a second corner 72 of the base portion 70, a third gap portion 89 positioned at a third corner 73 of the base portion 70, and a fourth gap portion 91 positioned at a fourth corner 75 of the base portion 7570. For further example, referring to FIG. 32, the gap 86 can include a first gap portion 87 positioned at a left side 92 of the base portion 70, and a second gap portion 88 positioned at a right side 93 of the base portion 70. For further example, referring to FIG. 32, the gap 86 can include a first gap portion 87 positioned at a front side 95 of the base portion 70, and a second gap portion 88 positioned at a back side 96 of the base portion 70. In other examples, the gap 86 can comprise any combination of the aforementioned gap sections and positions.

For example, and with reference to FIG. 24, in the illustrated construction a tool 820 is positioned in abutment with the HDMP 866. The tool 820 comprises a first plate 825 and a second plate 826. The first plate 825 comprising a lip 821 configured to receive at least a part of the base portion 870 of the HDMP 866. The lip 821 can define a recess configured to receive the first surface 878 along with the part of the base portion 870 received by the lip 821, wherein the aperture 803 can be positioned within the defined recess. In many constructions, the lip 821 is continuous around the entire recess. In other embodiments, the lip 821 can be discontinuous and have multiple sections defining the recess. The second plate 826 comprises at least on aperture 803 configured to receive the protrusion 802 of the HDMP 866 (FIG. 24 is a schematic representation of the HDMP 866 and tool 820, and shows only a single protrusion 802 and aperture 803, although as described above the HDMP 866 may have two or more protrusions 802 and the tool 820 may have two or more aperture 803). In many constructions, the lip 821 can extend entirely around the perimeter of the HDMP 866. In some constructions, the lip 821 can extend partially around the perimeter of the HDMP 866. In other constructions, the lip 821 can include one or more portions extending at least partially around the perimeter of the HDMP 866. The lip 821 comprises a lip height "LH" extending away from the plate 825 towards the HDMP 866. In the illustrated construction, the lip height "LH" is between 0.01 inch and 1 inches tall, although other values and ranges are also possible. For example, in some constructions, the lip 821 can be between 0.01 and 1.5 inches tall. In some constructions, the lip 821 can be 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1.0, 1.05, 1.1, 1.15, 1.2, 1.25, 1.3, 1.35, 1.4, 1.45 and 1.5 inches tall. Further, the lip 821 comprises a lip width "LW" extending in a direction parallel to the plate 825 and perpendicular to the lip height direction. In the illustrated embodiment, the lip width "LW" is between 0.01 inch and 1.0 inch in width "LW", although other values and ranges are also possible. For example, in some constructions, the lip 821 can be between 0.01 and 1.5 inches wide. In some constructions, the lip 821 can be 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1.0, 1.05, 1.1, 1.15, 1.2, 1.25, 1.3, 1.35, 1.4, 1.45 and 1.5 inches wide. Further, in the illustrated construction, the lip 821 has a rectangular cross section. In other constructions, the lip 821 can take any cross sectional shape. For example, the lip 821 can have a triangular, cylindrical, conical, spherical, cubical or any suitable cross sectional shape.

When the wax 818 is injected in the tool 820, the wax 818 surrounds at least a portion of the HDMP 866, forming a wax shell and encasement, as shown in FIG. 25. The process at least partially embeds the HDMP 866 in the wax 818 in a precise and repeatable manner. As illustrated in FIG. 25, the wax 818 at least partially embeds the flange 874 and the top portion 867, whereas the base portion 870 and the protrusion 802 are left exposed or disposed outside of (projecting out of) the wax 818. In some constructions, only a portion of the base portion 870 can be exposed outside of the wax 818. In other constructions, the entire base portion 870 and a portion of the top portion 867 can be exposed outside of the wax 818. Once the wax 818 has been injected, the process includes removing the tool 820, such that a gap 886 is formed between the portion of the HDMP 866 that was received in the lip 821 and the wax 818.

With reference to FIGS. 22 and 25, the embedded casting process 1094 further includes a fourth step 1122 of adding wax pieces to a wax setup, and a fifth step 1126 of coating the wax setup with a ceramic material, after removing the tool 820. As illustrated in FIG. 25 for example, the wax 818 forms at least one wax piece of a wax assembly for the golf club head 10. In some constructions, the wax assembly has a main wax body. Each wax piece is attached to the main wax body, forming the overall wax assembly that is used to form the golf club head body 14. In some constructions, a cone or cup (not shown) is attached to the wax assembly on a top of the wax assembly. This cone includes an opening through which molten material may be poured during a later step.

During the fifth step 1126, the wax assembly is dipped into a liquid ceramic slurry to form a ceramic shell 830 (FIG. 25) over the wax assembly. The wax assembly is provided with several layers of ceramic coating to form the ceramic shell 830, since several coats of ceramic achieves a desired strength that is sufficient for holding molten material in a later step of pouring in molten material into the ceramic shell 830. Each coating is dried before the next coating is applied. As illustrated in FIG. 25, during this step the HDMP 866 is at least partially embedded in a combination of the wax 818 and the ceramic shell 830, with the protrusion 802 being encased in the ceramic shell 830 but not penetrating through the ceramic shell 830 and the gap 886, created by the lip 821 receiving a part of the base portion 870, being occupied by the ceramic material forming the ceramic shell 830.

With reference again to FIG. 22, the embedded casting process 1094 further includes a sixth step 1134 of melting and removing the wax 818 creating a hollow region between the HDMP 866 and the ceramic shell 830. In the illustrated construction, after the ceramic shell 830 has dried, the wax 818 is melted by turning over the wax assembly and heating the wax assembly. During this sixth step 834, and as described further herein, the HDMP 866 is held rigidly in the ceramic shell 830 by the protrusion 802 and/or the ceramic filled gap 886; the protrusion 802 preventing translation along or in the direction of the z-axis relative to the ceramic shell 830, and the gap 886 preventing translation along or in the direction of the x or y-axis and prevents rotation about the z-axis relative to the ceramic shell 830. A hollow region forms between the ceramic shell 830 and the HDMP 866. The HDMP 866, with continued reference to FIG. 22, the embedded casting process 1094 further includes a seventh step 1138 of pre-heating the ceramic shell 830, and an eighth step 1142 of pouring molten material (e.g., metal) into the hollow region between the HDMP 866 and the ceramic shell 830 (e.g., through the opening in the cone described above). The molten material will form at least a portion of the golf club head body 14. The chosen pre-heated temperature depends, for example, on the material used for the golf club head body 14. During the eighth step 1142 the molten material at least partially embeds the HDMP 866, and as the molten material cools and solidifies, the HDMP 866 becomes an integral part of the final casting of the golf club head body 14 (i.e., becomes integrally embedded in the club head body 14).

In some constructions, the molten material is a stainless steel alloy, aluminum alloy, titanium alloy, or other low density, high strength metal, although other constructions include different materials. In some constructions, the molten material is a polymer plastic, a thermoplastic, a thermoset, or other similar material is melted and poured into the ceramic shell 830. In some constructions, the molten material is a steel-based material (e.g., 17-4 PH stainless steel, NITRONIC™ 50 austenitic stainless steel, maraging steel or other types of stainless steel), a titanium-based material such as Ti-9S, and Ti-6-4), an aluminum based material (e.g., a high strength aluminum alloy or a composite aluminum alloy coated with high strength alloy) or any combination thereof. The HDMP 866 may have a higher melting point than the molten material, such that the HDMP 866 does not melt or deform when in contact with the molten material forming the golf club head body 14.

As described above, the use of the protrusion 802 and/or the ceramic filled gap 886 inhibits or prevents the HDMP 866 from translating or rotating in any direction relative to the ceramic shell 830 during the embedded casting process 1094. In particular, the density of the molten material and the kinetic energy imparted by gravity and/or centrifugal motion tends to produce a force on the HDMP 866 during the eighth step 1142. The protrusion 802 and/or the ceramic filled gap 886 advantageously resist this force and hold the HDMP 866 in place, such that a precise positioning of the HDMP 866 and the resultant center of gravity or CG 52 is not adversely affected.

With continued reference to FIG. 22, the embedded casting process 1094 further includes a ninth step 1146 of removing the ceramic shell 830. The ceramic shell 830 is removed, for example, by physically breaking the ceramic shell 830 after the molten metal has cooled, such that the ceramic shell 830 shatters and falls off of the cooled metal and off of the HDMP 866. In some constructions, the ceramic shell 830 is removed by mechanical means such as vibration, impact, sand blast or fine tool work.

With continued reference to FIG. 22, the embedded casting process 1094 further includes a tenth step 1150 of separating cast parts from a larger assembly of cast parts. For example, the golf club head 10, a series of golf club heads 10, and/or one or more golf clubs overall, may be formed from a plurality of cast parts, such as one or more of the cast golf club head bodies 14 and HDMPs 866 described above. Once all of the cast parts are created as previously described, the parts are separated for further processing. In an eleventh step 1154, all gates and sprues from each cast part are removed.

Figure 26:
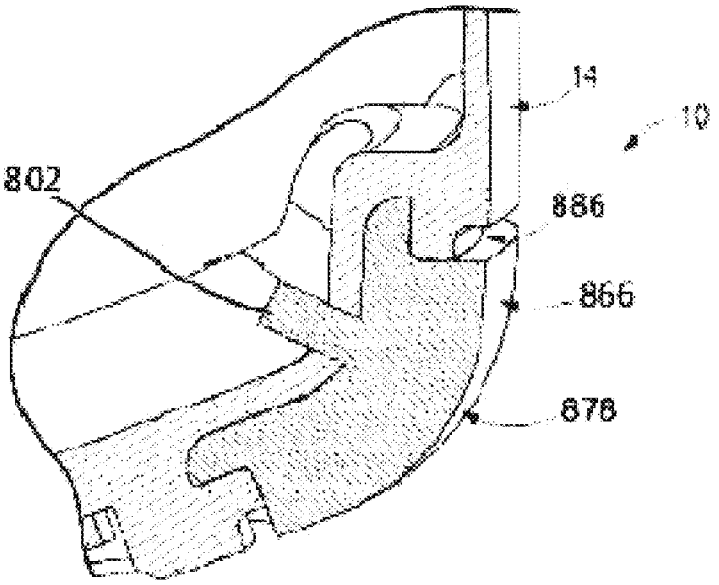
FIG. 26 is a partial, cross-sectional view of a portion of a golf club head, showing the HDMP of FIG. 25 coupled to a body of the golf club head.

FIG. 26 illustrates one of the cast golf club head bodies 14 and HDMPs 866 after the tenth step 1150. With the ceramic shell 830 having been removed, the first surface 878, along with the gap 886 are exposed along an outside of the golf club head 10 and the golf club head body 14. The HDMP 866 is held rigidly in place, having been cast into the golf club head body 14, with the gap 886 having been formed between the HDMP 866 and the golf club head body 14.

With reference to FIG. 22, the embedded casting process 1094 further includes a twelfth and final step 1162 of finishing the cast part or parts. For example, and with reference to FIG. 6, the gap 886 is filled in with the filler material 90 (e.g., paint, epoxy, rubber, silicon, or other flexible materials). In many constructions, the twelfth step of the embedded casting process 94 illustrated in FIG. 7, including removing the protrusion 102 from the first surface 78 of the HDMP 66 is not required, as the protrusion 802 of HDMP 866 used in embedded casting process 1094 is positioned on the interior of the club head 14.

Without the gap 886 and/or without the filler material 90, the HDMP 866 and the golf club head body 14 might otherwise contact one another along the outside of the golf club head body 14, i.e., along an exposed surface visible to a user. Contact at this junction between the golf club head body 14 and the HDMP 866 might cause the material (e.g., metal) in this region to become discolored in an undesirable way. For example, the juncture of the HDMP 866 and the golf club head body 14 along the outside of the golf club head body 14 is typically hotter than the rest of the golf club head body 14, at least for a period of time. This temperature difference may cause a visually undesirable appearance at the juncture due to oxidation between the HDMP 866 and the material of the golf club head body 14. Creation of the gap 886, as well as use of the filler material 90, thereby provides a means to separate the first surface 878 of the HDMP 866 from the golf club head body 14 in this region, and to prevent and/or hide any discoloration along the exterior of the finished golf club head 10. Further, the gap 886 prevents translation of the HDMP 866 in the x or y-axis and prevents rotation about the z-axis relative to the ceramic shell 830 during the casting process 1094.

The club head 10 having the HDMP 866 can be formed using the embedded casting process 1094 illustrated in FIG. 22. The embedded casting process 1094 described above advantageously positions the center of gravity or CG 52 of the golf club head 10. For example, The HDMP 866 has a higher density than the molten material that forms the golf club head body 14. Thus, when the HDMP 866 is cast into the golf club head body 14, the HDMP 866 causes the center of gravity or CG 52 to be moved to a desired location (e.g., at a lower, rearward location as illustrated in FIG. 3). In some constructions, the HDMP 866 is heavy enough to account for between 1/7 to 1/9 of a total mass of the golf club head 10 after being cast in place, although other constructions include different values and ranges.

The embedded casting process 1094 described above also advantageously maximizes the lower, rearward placement of the HDMP 866. For example the embedded casting process 1094 is able to move the center of gravity or CG 52 down and back much farther than currently used methods of placing an HDMP. Additionally, the embedded casting process 1094 minimizes supporting structures around the HDMP 866. This allows weight not used in such supporting structures to be redistributed elsewhere. The embedded casting process 1094 also eliminates welding, brazing, swaging, adhesive application, drilling and tapping and other time and labor-intensive operations. The embedded casting process 1094 also provides more design freedom for placement of the HDMP 866, as compared to other methods for joining an HDMP to a club head body that typically impose restrictions on positioning.

Further, the HDMP 866 and embedded casting process 1094 are advantageous as they do not require removal of protrusions from the HDMP 866. This step is not needed as the protrusion 802 extends inward relative to the club head 14 to prevent translation along or in the direction of the z-axis and the gap 886 prevents translation along or in the direction of the x or y-axis and prevents rotation about the z-axis securing the HDMP 866 in place during casting.

Figure 27:
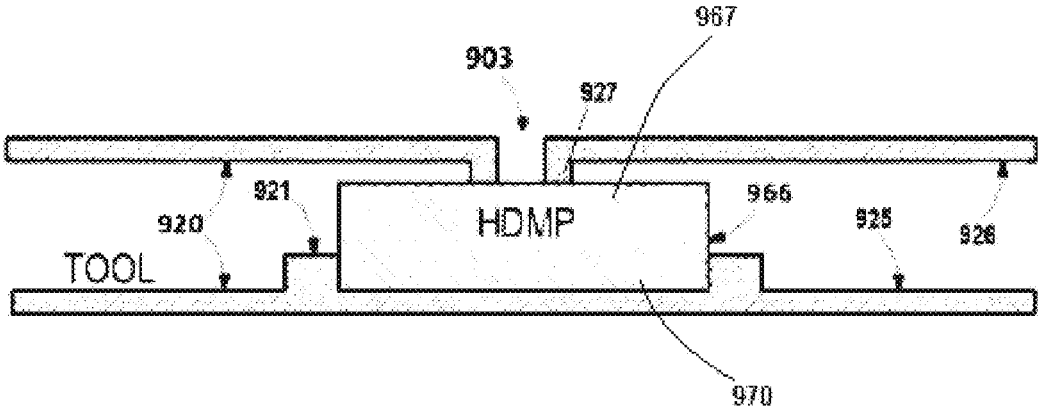
FIG. 27 is a schematic view of another HDMP during part of the process of FIG. 22, the HDMP being disposed in a tool.
Figure 28:
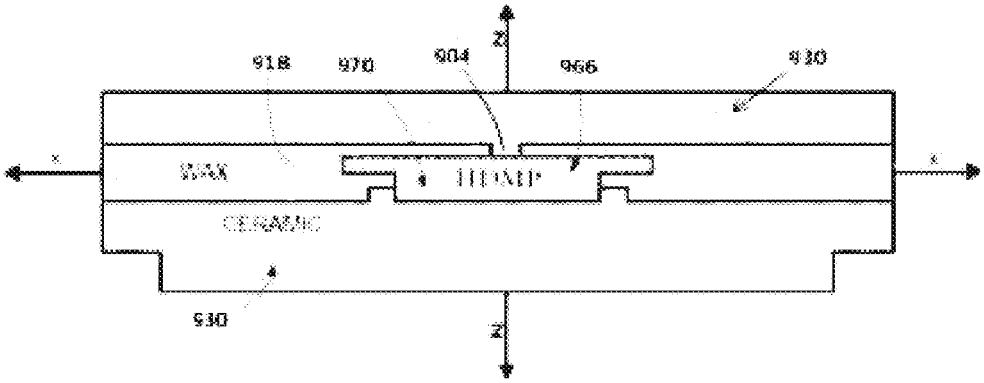
FIG. 28 is a schematic view of the HDMP during part of the process of FIG. 22, the HDMP embedded in wax and ceramic.
Figure 29:
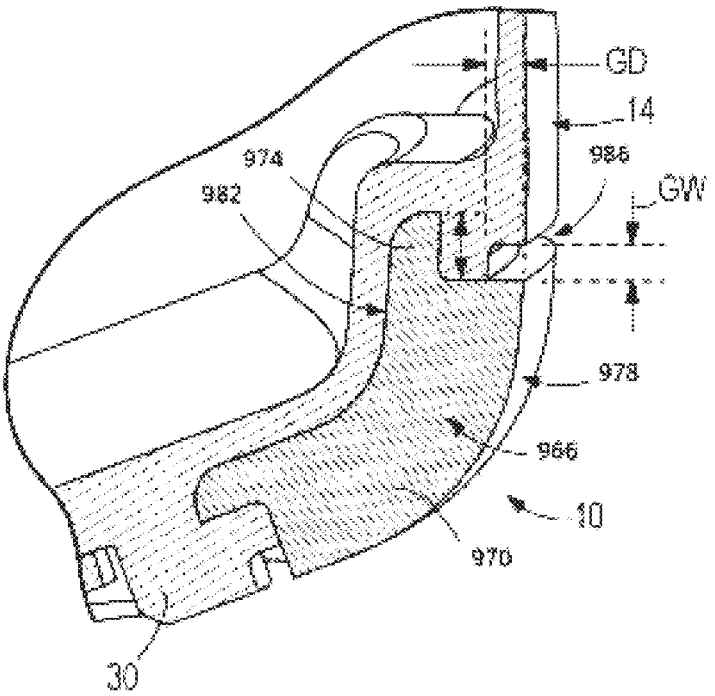
FIG. 29 is a partial, cross-sectional view of a portion of a golf club head, showing the HDMP of FIG. 27 coupled to a body of the golf club head.

FIGS. 27, 28 and 29 illustrate an HDMP 966 according to yet another construction. The HDMP 966 is made of tungsten, tantalum, rhenium, osmium, iridium, or platinum, although other constructions include different materials. The HDMP 966 is similar to HDMP 66, except that the HDMP 966 is devoid of any protrusions, as illustrated in FIG. 27. The club head 10 having HDMP 966 can be formed using the embedded casting process 1094 illustrated in FIG. 22.

Referring to FIG. 27, the tool 920, used for the wax injection according to the third step 1114, comprises a first plate 925 and a second plate 926. The tool 920 is similar to the tool 820 described above, except that the aperture 903 of the second plate 926 comprises a cylindrical wall 927 which extends from the second plate 925 inwards towards the first plate 925, or towards the second surface 982 of the HDMP 966. In the illustrated embodiment, the cylindrical wall 927 is between 0.01 inch and 1.5 inch in height "AH" (i.e., in a direction extending toward the first plate 925), although other values and ranges are also possible. For example, in some constructions, the aperture can be 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1.0, 1.05, 1.1, 1.15, 1.2, 1.25, 1.3, 1.35, 1.4, 1.45 and 1.5 inch tall. Further, in the illustrated embodiment, the aperture 903 has a rectangular cross-section. In other embodiments, the aperture 903 can have a triangular, conical, spherical, cubical or any other suitable cross-sectional shape.

When the wax 918 is injected into the tool 920, the wax surrounds at least a portion of the HDMP 966 similar to when the wax is injected into the tool 820 except the tool 920 creates an aperture 903 through the thickness of the wax 918 to the second surface 982 on the top portion 967 of the HDMP 966. This leaves a portion of the second surface 982 exposed to the exterior for step five 1126. Step five 1126, includes applying the ceramic shell 930 to the HDMP 966. The aperture 903 receives the ceramic material used to form the ceramic shell and creates a ceramic post 904 (FIG. 28) through the wax 918 adjacent to the second surface 982 of the HDMP 966. During the sixth step 1134, involving melting out the wax, the ceramic post 904 adjacent to the second surface 982, in combination with the portion of the ceramic shell 930 positioned on the first surface 978 of the HDMP 966, prevent the HDMP 966 from translating along or in the direction of the z-axis.

In other embodiments, the tool 920 can create a plurality of apertures. These apertures function similarly to aperture 903 in that each receives the ceramic material used to form the ceramic shell and creates a plurality of ceramic posts. For example, in some embodiments, the tool 920 can be configured to create one, two, three, four, five, or six apertures 903 that receive the ceramic material used to form the ceramic shell and creates a plurality of ceramic posts. Each ceramic post extends through the wax 918 adjacent to the second surface 982 of the HDMP 966. During the sixth step 1134, involving melting out the wax, the ceramic posts adjacent to the second surface 982, in combination with the portion of the ceramic shell 930 positioned on the first surface 978 of the HDMP 966, prevent the HDMP 966 from translating along or in the direction of the z-axis. In other embodiments, the tool 920 can be configured to create any number of apertures similar to aperture 903. In some embodiments, the apertures may be separated by a constant distance. In other embodiments, the apertures may be separated by irregular distance. In some embodiments, each aperture may have the same cross-sectional size. In other embodiments, each aperture may have a different cross-sectional size.

Referring to FIGS. 28 and 29, the HDMP 966, in combination with the club head body 14, forms a gap 986 between the base portion 970 and the golf club head body 14 along an exterior of the golf club head 10. The outer surface of the base portion 970 being the portion of the HDMP 966 which will be exposed to the exterior of the golf club head 10 when the casting process 1094 is completed. The gap 986 is similar to the gap 86 illustrated in FIG. 5. The gap 986 can extend entirely around the base 970 or may extend only partially around the base 970 creating gap sections. In other constructions, the gap 86 can include one or more portions extending at least partially around the base portion 70 creating a plurality of gap sections. For example, referring to FIG. 30, the gap can include a single first gap portion 87 extending around approximately half of the base portion 70. For further example, referring to FIG. 31, the gap 86 can include a first gap portion 87 positioned at a corner 71 of the base portion 70, a second gap portion 88 positioned at a second corner 72 of the base portion 70, a third gap portion 89 positioned at a third corner 73 of the base portion 70, and a fourth gap portion 91 positioned at a fourth corner 75 of the base portion 70. For further example, referring to FIG. 32, the gap 86 can include a first gap portion 87 positioned at a left side 92 of the base portion 70, and a second gap portion 88 positioned at a right side 93 of the base portion 70. For further example, referring to FIG. 32, the gap 86 can include a first gap portion 87 positioned at a front side 95 of the base portion 70, and a second gap portion 88 positioned at a back side 96 of the base portion 70. In other examples, the gap 86 can comprise any combination of the aforementioned gap sections and positions. Further, the gap may extend from 0.01 to 1 in deep in a gap depth direction "GD" (i.e., in a direction generally inwardly toward a center of the club head), although other values and ranges are also possible. For example, in some constructions, the gap 986 is between 0.01 and 1.25 inches deep. In some constructions, the gap 986 is between 0.01 and 1.5 inches deep. In the illustrated construction, the gap 986 is also between 0.01 inch and 1 inch wide in a gap width direction "GW" (i.e., in a direction extending between the outer, first surface 978 and the outer surface of the golf club head body 14, and perpendicular to the gap depth direction), although other values and ranges are also possible. For example, in some constructions the gap 986 is between 0.01 inch and 1.25 inches wide. In some constructions, the gap 986 is between 0.01 and 1.5 inches wide. The gap 986 receives the ceramic material that forms the ceramic shell 903. The ceramic shell 903 then prevents the HDMP 966 from translating along or in the direction of the x or y-axis and from rotating about the z-axis relative to the ceramic shell 930 during the casting process 1094.

Further, the HDMP 966 and embedded casting process 1094 are advantageous as they do not require removal of protrusions from the HDMP 966. This step is not needed as the HDMP 966 is devoid of any protrusions. The ceramic post 904 along with the portion of the ceramic shell 930 positioned along the first surface 978 of the HDMP 966 prevent translation of the HDMP 966 along or in the direction of the z-axis relative to the ceramic shell 930 during casting process 1094. Further, the gap 986 prevents the HDMP 966 from translating along or in the direction of the x or y-axis and from rotating about the z-axis relative to the ceramic shell 930 during the casting process 1094. These features of HDMP 966 reduce manufacturing cost and time to improve efficiency.

The HDMP 66, 266, 366, 466, 566, 666, 766, 866, 966 described herein prevents undesired movements associated with forces applied during the sixth 134, 1134, seventh, 138, 1138, and eighth 142, 1142 steps of the embedded casting process 94, 1094. These forces can cause the HDMP 66, 266, 366, 466, 566, 666, 766, 866, 966 to translate or rotate in an undesired manner during the casting process in the direction of or about the z-axis, x-axis, and y-axis or any combination thereof. The protrusions 102, 370, 470, 586, 802 and the gaps 86, 286, 886, 986 prevent undesired movements (ie. translations or rotations) of the HDMP 66, 266, 366, 466, 566, 666, 766, 866, 966 during the casting process 94, 1094.

For example, in some embodiments, translation along or in the direction of the x-axis can be inhibited or prevented by the gap 86, 286, 886, 986 and/or by the protrusions 102, 370, 470, 586, 802. In some embodiments, the gap 986 can prevent translation of the HDMP 966 devoid of protrusions 102, 370, 470, 586, 802 along or in the direction of the x-axis. In other embodiments, the gap 86, 286, 886 can prevent the HDMP 66, 266, 366, 466, 566, 666, 766, 866 from translation along or in the direction of the x-axis instead of or in addition to protrusions 102, 370, 470, 586, 802.

For further example, in some embodiments, translation along or in the direction of the y-axis can be inhibited or prevented by the gap 86, 286, 886, 986 and/or by the protrusions 102, 370, 470, 586, 802. In some embodiments, the gap 986 can prevent translation of the HDMP 966 devoid of protrusions 102, 370, 470, 586, 802 along or in the direction of the y-axis. In other embodiments, the gap 86, 286, 886 can prevent the HDMP 66, 266, 366, 466, 566, 666, 766, 866 from translation along or in the direction of the y-axis instead of or in addition to protrusions 102, 370, 470, 586, 802.

For further example, in some embodiments, translation along or in the direction of the z-axis can be inhibited or prevented by the ceramic post 904 and/or by the protrusions 102, 370, 470, 586, 802. In some embodiments, the ceramic post 904 can prevent translation of the HDMP 966 devoid of protrusions 102, 370, 470, 586, 802 along or in the direction of the z-axis. In other embodiments, the protrusions 102, 370, 470, 586, 802 can prevent the HDMP 66, 266, 366, 466, 566, 666, 766, 866 from translation along or in the direction of the z-axis.

For further example, in some embodiments, rotation about the z-axis can be inhibited or prevented by the gap 86, 286, 886, 986 and/or by the protrusions 102, 370, 470, 586. In some embodiments, the gap 886, 986 can prevent translation of the HDMP 866, 966 devoid of protrusions 102, 370, 470, 586, 802 along or in the direction of the z-axis. In other embodiments, the gap 86, 286 can prevent the HDMP 66, 266, 366, 466, 566, 666, 766 from rotating about the z-axis instead of or in addition to protrusions 102, 370, 470, 586.

In the illustrated embodiments, rotation about the x-axis and rotation about the y-axis is inherently prevented by the structure of the HDMP 66, 266, 366, 466, 566, 666, 766, 866, 966 and the casting mold in combination with the gap 86, 286, 886, 986 or protrusions 102, 370, 470, 586, 802.

The embedded casting processes 94, 1094 and the HDMPs described herein are merely exemplary and are not limited to the constructions presented herein. For example, the embedded casting process 94, 1094 can be employed in many different constructions or examples not specifically depicted or described herein. In some constructions, the embedded casting process 94, 1094 can be performed in any suitable order. In some constructions, one or more of the steps of the embedded casting process 94, 1094 may be combined, separated, or skipped.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to a variety of types of golf clubs including drivers, fairway woods, hybrids, crossovers, or any hollow body type golf clubs. Alternatively, the apparatus, methods, and articles of manufacture described herein may be applicable to other types of sports equipment such as a hockey stick, a tennis racket, a fishing pole, a ski pole, etc.

While the above examples describe an HDMP as being located at a particular location along the x-axis 54, y-axis 58, and z-axis 62, in other constructions an HDMP is located at other locations (e.g., locations that are along the same x-axis but are moved along the y-axis toward or away from the crown or top 26 and along the z-axis 62 toward or away from the club face or face or strike face or strike plate 36, or locations that are along the same y-axis 58 but are moved along the x-axis 54 toward or away from the heel end 22 and along the z-axis 62 toward or away from the club face or face or strike face or strike plate 36). Additionally, in some constructions more than one HDMP is coupled to a golf club head and positioned as previously described.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. An investment casting part for a golf club head, the investment casting part comprising a high density metal piece at least partially embedded within a wax shell, the high density metal piece having a body with at least two protrusions that extend from the body and away from the wax shell, the at least two protrusions extending along axes that are offset relative to one another.

Clause 2. The investment casting part of clause 1, wherein the axes are parallel to one another.

Clause 3. The investment casting part of clause 1, wherein the at least two protrusions are each cylindrical.

Clause 4. The investment casting part of clause 1, wherein the high density metal piece includes a base portion and a flange extending from the base portion, wherein the base portion includes a first surface and the flange includes a second surface disposed opposite the first surface, wherein the at least two protrusions each extend from the first surface.

Clause 5. The investment casting part of clause 4, wherein the flange extends entirely around a perimeter of the high density metal piece.

Clause 6. The investment casting part of clause 4, wherein the flange extends between 0.005 inch and 2.0 inches away from the base portion.

Clause 7. The investment casting part of clause 1, further comprising a ceramic shell disposed over at least a portion of the wax shell, wherein the at least two protrusions are disposed at least partially within the ceramic shell.

Clause 8. An investment casting part for a golf club head, the investment casting part comprising a high density metal piece including a body having a surface, a first protrusion extending from the surface, and a second protrusion extending from the surface offset from the first protrusion; and a wax encasement, wherein the wax encasement surrounds the body, further wherein the first protrusion and the second protrusion each extend away from the wax encasement.

Clause 9. The investment casting part of clause 8, wherein the first protrusion and the second protrusion are cylindrical.

Clause 10. The investment casting part of clause 8, wherein the body includes a base portion and a flange extending from the base portion, wherein the base portion includes a first surface and the flange includes a second surface disposed opposite the first surface, wherein the first protrusion and the second protrusion each extend from the first surface.

Clause 11. The investment casting part of clause 10, wherein the flange extends entirely around a perimeter of the high density metal piece.

Clause 12. The investment casting part of clause 10, wherein the flange extends between 0.005 inch and 2.0 inches away from the base portion.

Clause 13. The investment casting part of clause 8, further comprising a ceramic shell disposed over at least a portion of the wax encasement, wherein the first protrusion and the second protrusion are each disposed at least partially within the ceramic shell.

Clause 14. An investment casting part for a golf club head, the head being that of a metal wood, the investment casting part comprising a high density metal piece including a body having a surface and a cylindrical or non-cylindrical protrusion extending from the surface, the protrusion including a notch formed therein; and a wax encasement with an outer surface, wherein the wax encasement at least partially surrounds the body, further wherein the notch is free from contact with the wax encasement.

Clause 15. The investment casting part of clause 14, wherein the protrusion is a non-cylindrical protrusion having a first end at the surface and a second end disposed opposite the first end and distal the surface, and wherein the notch is disposed between the first end and the second end.

Clause 16. The investment casting part of clause 14, wherein the protrusion is a cylindrical protrusion having a first end at the surface and a second end disposed opposite the first end and distal the surface, and wherein the notch is disposed at the second end.

Clause 17. The investment casting part of clause 14, wherein the protrusion has a triangular-shaped cross-section.

Clause 18. The investment casting part of clause 14, further comprising a ceramic shell disposed on the wax encasement, wherein the protrusion is disposed within the ceramic shell.

Clause 19. A golf club head comprising:

a golf club head body having a sole, a striking face, a crown, a heel end, and a toe end;

a high density metal piece coupled to the golf club head body, wherein a gap is disposed between an exterior surface of the high density metal piece and an exterior surface of the golf club head body, wherein a filler material is disposed within the gap.

Clause 20. The golf club head of clause 19, wherein the gap extends entirely around the high density metal piece.

Clause 21. The golf club head of clause 19, wherein the high density metal piece includes a base portion and a flange extending from the base portion, wherein the base portion is exposed along an exterior of the golf club head, and wherein the gap is disposed between the base portion and the golf club head body.

Clause 22. The golf club head of clause 21, wherein the gap is between 0.01 inch and 1 inch wide in a gap width direction that extends generally inwardly toward a center of the golf club head.

Clause 23. The golf club head of clause 22, wherein the gap is between 0.01 inch and 1 inch deep in a gap depth direction that extends generally tangential to an outer contour of the golf club head, and perpendicular to the gap width direction.

Clause 24. The golf club head of clause 19, wherein the filler material is selected from a group consisting of paint, epoxy, rubber, and silicon.

Clause 25. The golf club head of clause 19, wherein the golf club head body is made of a material selected from a group consisting of a stainless steel alloy, an aluminum alloy, a titanium alloy, a polymer plastic, a thermoplastic, and a thermoset.

Clause 26. The golf club head of clause 25, wherein the golf club head body is made of a material selected from a group consisting of 17-4 PH stainless steel, NITRONIC™ 50 austenitic stainless steel, maraging steel, Ti-9S, and Ti-6-4.

Clause 27. The golf club head of clause 19, wherein the high density metal piece is made of a material selected from a group consisting of tungsten, tantalum, rhenium, osmium, iridium, and platinum.

Clause 28. A method of manufacturing a golf club head comprising forming a high density metal piece, the high density metal piece having at least one protrusion, positioning the high density metal piece in a wax injection mold, injecting wax into the wax injection mold, such that a portion of the at least one protrusion is not embedded within the wax, coating the wax with ceramic, such that the portion of the at least one protrusion is disposed within the ceramic, melting the wax to form a hollow region between the ceramic and the high density metal piece, pouring metal into the hollow region; and removing the ceramic; wherein after the ceramic is removed, a gap is disposed between an exterior surface of the high density metal piece and an exterior surface of the body; and inserting a filler material into the gap.

Clause 29. The method of clause 28, further comprising removing the at least one protrusion by at least one of grinding, laser removal, machining, and electrical discharge machining (EDM).

Clause 30. The method of clause 29, wherein the at least one protrusion includes a notch, and wherein the step of coating the wax with ceramic includes filling the notch with ceramic material.

Clause 31. The method of clause 30, wherein the high density metal piece does not translate or rotate relative to the ceramic during the step of pouring the metal.

Clause 32. A partially assembled golf club head comprising a body having a sole, a striking face, a crown, a heel end, and a toe end; and a high density metal piece coupled to the body, wherein a gap is disposed between an exterior surface of the high density metal piece and an exterior surface of the body, wherein the high density metal piece includes two protrusions extending away from the golf club head.

Clause 33. A method of manufacturing a golf club head comprising: forming a high density metal piece; placing the high density metal piece in a wax injection mold; positioning a tool in abutment with the high density metal piece, the tool including a lip that receives at least a portion of the high density metal piece; injecting wax into the wax injection mold to at least partially embed portions of the high density metal piece within the wax, wherein the portion of the high density metal piece received by the lip is exposed outside of the wax; removing the tool from the wax injection mold, such that a gap is formed between the portion of the high density metal piece that was received by the lip and the wax; coating the wax and at least one portion of the high density metal piece with a ceramic material forming a ceramic shell, wherein the gap is occupied by the ceramic material; melting the wax to form a hollow region between the ceramic shell and the high density metal piece, wherein the high density metal piece is held rigidly in place via the ceramic filled gap; pouring metal into the hollow region, the metal forming a body of the golf club head and at least partially surrounding the high density metal piece wherein the ceramic filled gap prevents the high density metal piece from translating along or in an x or y-axis and from rotating about a z-axis; and removing the ceramic, such that the high density metal piece and a portion of the body of the golf club head form a gap.

Clause 34. The method of clause 33, further comprising the step of filling the gap with a filler material after removing the ceramic.

Clause 35. The method of clause 33, wherein the filler material is at least one of a paint, epoxy, rubber, and silicone.

Clause 36. The method of clause 33, wherein the gap has a depth between 0.01 inches and 1 inches.

Clause 37. The method of clause 33, wherein the gap has a width between 0.01 inches and 1 inches.

Clause 38. The method of clause 33, wherein the high density metal piece that abuts the tool comprises a first surface exposed to the exterior of the club head, and wherein the first surface includes at least one protrusion extending outward from the golf club head.

Clause 39. The method of clause 38, further comprising the step of removing the at least one protrusion by at least one method selecting from the group consisting of grinding, laser removal, machining, and electrical discharge machining after the removal of the ceramic.

Clause 40. The method of clause 38, wherein the first surface comprises two protrusions extending outward from the golf club head, and wherein the protrusions include a cross section which is symmetrical or non-symmetrical Clause 41. The method of clause 33, wherein the high density metal piece comprises a first surface exposed to the exterior of the club head and a second surface opposite the first surface, wherein the second surface comprises at least one protrusion.

Clause 42. A golf club head comprising: a club head body; and a high density metal piece integrally embedded in the club head body, the high density metal piece comprising a base portion having a first surface exposed to the exterior of the club head body, wherein an exterior surface of the club head body and the first surface of the high density metal piece form a gap disposed between them, the gap extending towards an interior of the club head body exposing a perimeter of the base portion, wherein oxidation and discoloration caused during the manufacturing process are not visible on the exposed first surface.

Clause 43. The golf club head of clause 42, wherein the gap is filled with a filler material.

Clause 44. The golf club head of clause 43, wherein the filler material is at least one of a paint, epoxy, rubber, and silicone.

Clause 45. The golf club head of clause 44, wherein the high density metal piece comprises a second surface opposite the first surface, and wherein the second surface comprises at least one protrusion extending towards the interior of the golf club head.

Clause 46. The golf club head of clause 45, wherein the second surface comprises two protrusions extending along axes that are parallel to one and other.

Clause 47. The golf club head of clause 45, wherein the at least one protrusion comprises a notch.

Clause 48. The golf club head of clause 42, wherein the high density metal piece comprises a top portion positioned towards the interior of the club head, and wherein a flange extends from the top portion of the high density metal piece.

Clause 49. The golf club head of clause 42, wherein the gap has a depth between 0.01 inches and 1 inches.

Clause 50. The golf club of clause 42, wherein the gap has a width between 0.01 inches and 1 inches.

Clause 51. A wax injection mold for a golf club head, the wax injection mold comprising: a removable tool having a plate with a lip defining a recess, wherein the tool is configured to abut a high density metal piece such that the lip receives at least a portion of the high density metal piece to form a gap upon removal of the tool between the portion of the high density metal piece and a wax previously injected into the mold.

Clause 52. The wax injection mold of clause 51 wherein the lip has a height between 0.01 inches and 1 inches and a width between 0.01 inches and 1 inches.

Various features and advantages of the disclosure are set forth in the following claims.

The invention claimed is:

1. A golf club head comprising:

a club head body; and wherein the club head body comprises a metallic club head body material;

a high density metal piece integrally embedded in the club head body, wherein the high density metal piece is embedded in the club head body at a club head body back end and along a club head body sole or bottom in an area of transition from a rear of the sole or bottom to a perimeter of the golf club head;

the high density metal piece comprising a base portion having a first surface exposed to an exterior of the club head body, wherein the high density metal piece comprises a curved shape;

wherein the high density metal piece is made of a material selected from a group consisting of tungsten, tantalum, rhenium, osmium, iridium, and platinum;

wherein the high density metal piece further comprises a top portion positioned towards an interior of the club head body, and the base portion is positioned closest to the exterior of the club head body;

wherein the top portion comprises a second surface opposite the first surface, and the base portion comprises the first surface;

wherein the second surface of the top portion extends along an arc;

wherein a flange extends along the arc from the top portion of the high density metal piece;

wherein the second surface extends uninterrupted from the top portion to the flange;

and wherein the high density metal piece further comprises at least one through-hole;

wherein the high density metal piece is embedded in the golf club head body such that the club head body metallic material is within the at least one through-hole, and supported and gripped by the solidified metallic material within the at least one through-hole of the high density metal piece;

wherein the exterior surface of the club head body and the first surface of the high density metal piece form a gap disposed between them, the gap extending towards the interior of the club head body exposing a perimeter of the base portion, wherein oxidation and discoloration caused during the manufacturing process are not visible on the exposed first surface.

2. The golf club head of claim 1, wherein the gap is filled with a filler material.

3. The golf club head of claim 2, wherein the filler material is at least one of a paint, epoxy, rubber, and silicone.

4. The golf club head of claim 1, wherein the second surface comprises at least one protrusion extending towards the interior of the golf club head.

5. The golf club head of claim 4, wherein the second surface comprises two protrusions extending along axes that are parallel to one and other.

6. The golf club head of claim 4, wherein the at least one protrusion comprises a notch.

7. The golf club of claim 6, wherein the notch defines a cut-out region on the at least one protrusion.

8. The golf club of claim 7, wherein the notch comprises a notch length as measured along a length of the at least one protrusion.

9. The golf club of claim 8, wherein the notch length is at least 0.005 inch.

10. The golf club head of claim 1, wherein the gap has a depth between 0.01 inches and 1 inches.

11. The golf club head of claim 1, wherein the gap has a width between 0.01 inches and 1 inches.

* * * * *